US010087665B2

(12) United States Patent
Gillen et al.

(10) Patent No.: US 10,087,665 B2
(45) Date of Patent: Oct. 2, 2018

(54) DOOR ASSEMBLY

(71) Applicant: Therma-Tru Corp., Maumee, OH (US)

(72) Inventors: Seth R. Gillen, Hamilton, IN (US); Jarrod Buffy, Waterville, OH (US)

(73) Assignee: THERMA-TRU CORP, Maumee, OH (US)

( * ) Notice: Subject to any disclaimer, the term of this patent is extended or adjusted under 35 U.S.C. 154(b) by 64 days.

(21) Appl. No.: 14/683,496

(22) Filed: Apr. 10, 2015

(65) Prior Publication Data

US 2015/0300057 A1 Oct. 22, 2015

Related U.S. Application Data

(60) Provisional application No. 61/979,234, filed on Apr. 14, 2014.

(51) Int. Cl.

| | |
|---|---|
| ***E05C 19/00*** | (2006.01) |
| ***E05B 63/00*** | (2006.01) |
| *E05B 47/00* | (2006.01) |

(52) U.S. Cl.
CPC ..... *E05C 19/002* (2013.01); *E05B 63/0052* (2013.01); *E05B 47/0004* (2013.01); *E05B 47/0006* (2013.01); *E05B 2047/0094* (2013.01)

(58) Field of Classification Search
CPC ..... E05B 47/0047; E05B 47/0006; E05B 47/0004; E05B 17/0029; E05B 17/0025;
(Continued)

(56) References Cited

U.S. PATENT DOCUMENTS 2,910,859 A * 11/1959 Allen ..... E05B 47/0047 292/198
3,451,704 A * 6/1969 Cothron ..... E05B 57/00 292/198

(Continued)

FOREIGN PATENT DOCUMENTS

GB 2325691 A 12/1998

OTHER PUBLICATIONS

International Search Report and Written Opinion from PCT/US2015/025292 dated Jul. 10, 2015, 25 pages.

*Primary Examiner* — Justin B Rephann
(74) *Attorney, Agent, or Firm* — Calfee, Halter & Griswold LLP

(57) ABSTRACT

A door assembly includes a door frame and a door coupled to the door frame and movable between an open and closed position. The door includes a first surface that faces in a first direction and a second surface that faces in a direction that is greater than 90 degrees from the first direction. The door assembly also includes a securing member pivotably mounted to the door frame and pivotable between a first position, in which the securing member prevents the door from moving to the open position, and a second position, in which the securing member releases the door, wherein the securing member is configured to engage both the first surface and the second surface when the securing member is in the first position. The door assembly may also include a latching assembly mounted to the door frame, wherein, in a first state, the latching assembly holds the securing member in the first position, and, in a second state, the latching assembly releases the securing member to allow the securing member to pivot from the first position to the second position.

5 Claims, 19 Drawing Sheets

(58) Field of Classification Search
CPC ..... E05B 63/0052; E05B 2047/0094; E05C 19/002; Y10T 16/27
See application file for complete search history.

(56) References Cited

U.S. PATENT DOCUMENTS 3,774,422 A * 11/1973 Hogan ..... E05B 47/0047 292/341.16
3,874,715 A * 4/1975 Beudat ..... E05C 19/001 292/261
3,910,617 A * 10/1975 Scalza ..... E05L 347/0047 292/341.16
3,969,845 A 7/1976 Yulkowski
3,977,711 A * 8/1976 Lajcak ..... E05C 19/002 292/202
4,188,753 A * 2/1980 Colombo ..... E05C 19/001 292/5
4,656,779 A * 4/1987 Fedeli ..... E06B 5/113 49/318
5,822,924 A 10/1998 Wijninga et al.
5,987,818 A * 11/1999 Dabideen ..... E05B 17/0029 292/144
6,010,168 A * 1/2000 Johnson ..... E05B 15/0086 292/207
6,185,871 B1 * 2/2001 Wang ..... E05B 63/20 49/501
6,685,242 B2 * 2/2004 Furner ..... E05B 47/0603 292/341.16
6,966,585 B2 * 11/2005 Egi ..... E05B 47/0047 292/144
7,472,934 B2 * 1/2009 Burke ..... E05B 47/0047 292/340
8,484,900 B2 * 7/2013 Charnesky ..... B60J 5/0479 296/146.9
8,539,717 B2 * 9/2013 Speyer ..... E06B 7/21 49/25
9,255,425 B2 * 2/2016 Wittke ..... E05B 17/0029
2004/0032130 A1 * 2/2004 Oxley ..... E05B 47/0047 292/201
2008/0136200 A1 * 6/2008 Wittke ..... E05B 47/0047 292/341.16
2009/0033107 A1 * 2/2009 Zimmer ..... E05B 15/0086 292/302
2012/0174337 A1 * 7/2012 Wittke ..... E05B 17/0029 16/51
2013/0000205 A1 * 1/2013 Raz ..... E05B 17/0025 49/366
2013/0328332 A1 12/2013 Scheffler et al.
2014/0239647 A1 * 8/2014 Jadallah ..... E05C 19/002 292/140
2016/0376821 A1 * 12/2016 Ward ..... E05B 63/0052 49/394
2017/0254119 A1 * 9/2017 Raz ..... E05B 17/2007

* cited by examiner

DOOR ASSEMBLY

CROSS REFERENCE TO RELATED APPLICATIONS

This application claims priority to and any benefit from U.S. Provisional Patent Application Ser. No. 61/979,234, filed Apr. 14, 2014, and entitled "DOOR ASSEMBLY," the entire disclosure of which is incorporated herein by reference.

FIELD OF INVENTION

The present invention relates generally to the field of door frames and door assemblies and more particularly to door frames having a movable portion configured to secure a door.

BACKGROUND

Doors have been used for centuries to provide and deny access through openings and passageways. Various mechanisms have been used to secure a door in a closed position in an opening or passageway. A common arrangement includes a door pivotably mounted in a door frame by hinges. The door includes a latch that cooperates with a strike plate fixed to the door frame to latch the door in the closed position or allow the door to be opened by withdrawing the latch from the strike plate. A wide variety of latches are known. For example, the latch may be a spring bolt that is retracted by turning a door knob and/or the latch may be a deadbolt.

AU-A-22809/02 to Arthur Colin Driscoll discloses a door assembly that includes a door frame with a retractable cover. The door assembly includes a traditional latch and striker plate arrangement to hold the door in the closed position. When, however, a deadbolt on the door is latched to the doorframe, the deadbolt rotates the cover to cover the gap between the door frame and the door. Thus, the cover acts as improved security by preventing access to the deadbolt from a location exterior to the door while the deadbolt and latch on the door secure the door in the closed position.

SUMMARY

The present patent application discloses exemplary embodiments of door assemblies. In an exemplary embodiment, a door assembly may include a door frame and a door coupled to the door frame and movable between an open and closed position. The door may include a first surface that faces in a first direction and a second surface that faces in a direction that is greater than 90 degrees from the first direction. The door assembly may also include a securing member pivotably mounted to the door frame and pivotable between a first position, in which the securing member prevents the door from moving to the open position, and a second position, in which the securing member releases the door, wherein the securing member is configured to engage both the first surface and the second surface when the securing member is in the first position.

In an exemplary embodiment, the door assembly may include a latching assembly mounted to the door frame, wherein, in a first state, the latching assembly holds the securing member in the first position, and, in a second state, the latching assembly releases the securing member to allow the securing member to pivot from the first position to the second position.

BRIEF DESCRIPTION OF THE SEVERAL VIEWS OF THE DRAWINGS

The accompanying drawings, which are incorporated in and constitute a part of this specification, illustrate some embodiments disclosed herein, and together with the description, serve to explain principles of the embodiments disclosed herein.

DETAILED DESCRIPTION

The embodiments disclosed herein will now be described by reference to some more detailed embodiments, in view of the accompanying drawings. These embodiments may, however, be embodied in different forms and should not be construed as limited to the embodiments set forth herein. Rather, these embodiments are provided so that this disclosure will be thorough and complete, and will fully convey the scope of the inventions to those skilled in the art.

Unless otherwise defined, all technical and scientific terms used herein have the same meaning as commonly understood by one of ordinary skill in the art to which these embodiments belong. The terminology used in the description herein is for describing particular embodiments only and is not intended to be limiting of the embodiments. As used in the specification and the appended claims, the singular forms "a," "an," and "the" are intended to include the plural forms as well, unless the context clearly indicates otherwise. All publications, patent applications, patents, and other references mentioned herein are incorporated by reference in their entirety.

Notwithstanding that the numerical ranges and parameters setting forth the broad scope of the embodiments are approximations, the numerical values set forth in the specific examples are reported as precisely as possible. Any numerical value, however, inherently contains certain errors necessarily resulting from the standard deviation found in their respective testing measurements. Every numerical range given throughout this specification and claims will include every narrower numerical range that falls within such broader numerical range, as if such narrower numerical ranges were all expressly written herein.

Figure 1:
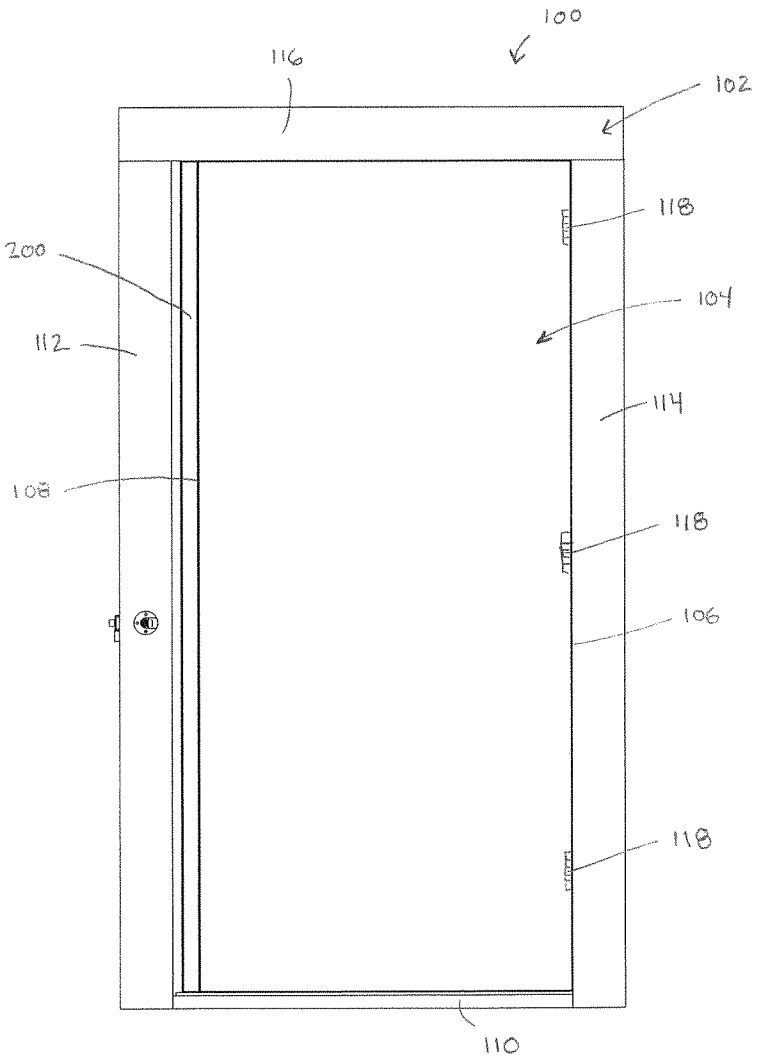
FIG. 1 is a front view of an exemplary embodiment of a door assembly.

FIG. 1 illustrates an exemplary embodiment of a door assembly 100 that includes a door frame 102 and a door 104 that is connected to the frame, such that the door is pivotable between an open position and a closed position (FIG. 1). The door assembly 100 may take a wide variety of different forms and be used in a variety of applications. For example, in an exemplary embodiment, the door is a residential building door, such as an entrance door of a house. As further example, in an exemplary embodiment, the door assembly may be used on a vehicle, an appliance, or any other apparatus or device in which a door closes an opening or passageway. The door 104 may be connected to the door frame in a wide variety of different ways. In the exemplary embodiment of FIG. 1, the door 104 includes an inner end portion 106 and an outer end portion 108. The door frame 102 includes a sill section 110, a first side section 112, a second side section 114, and a top section 116. The inner end portion 106 may be connected to the frame 102 with hinges 118. Any one or more of the door frame sections may also include additional accessories. For example, the door frame 102 may include jamb stops, a trim piece, such as a brick molding, that hides the interface between a wall and the door frame, a frame extending component, such as a screen door adapter or track, or a sill extending component, such as a sill extender that attaches to the sill to cover a larger rough frame member.

Figure 2:
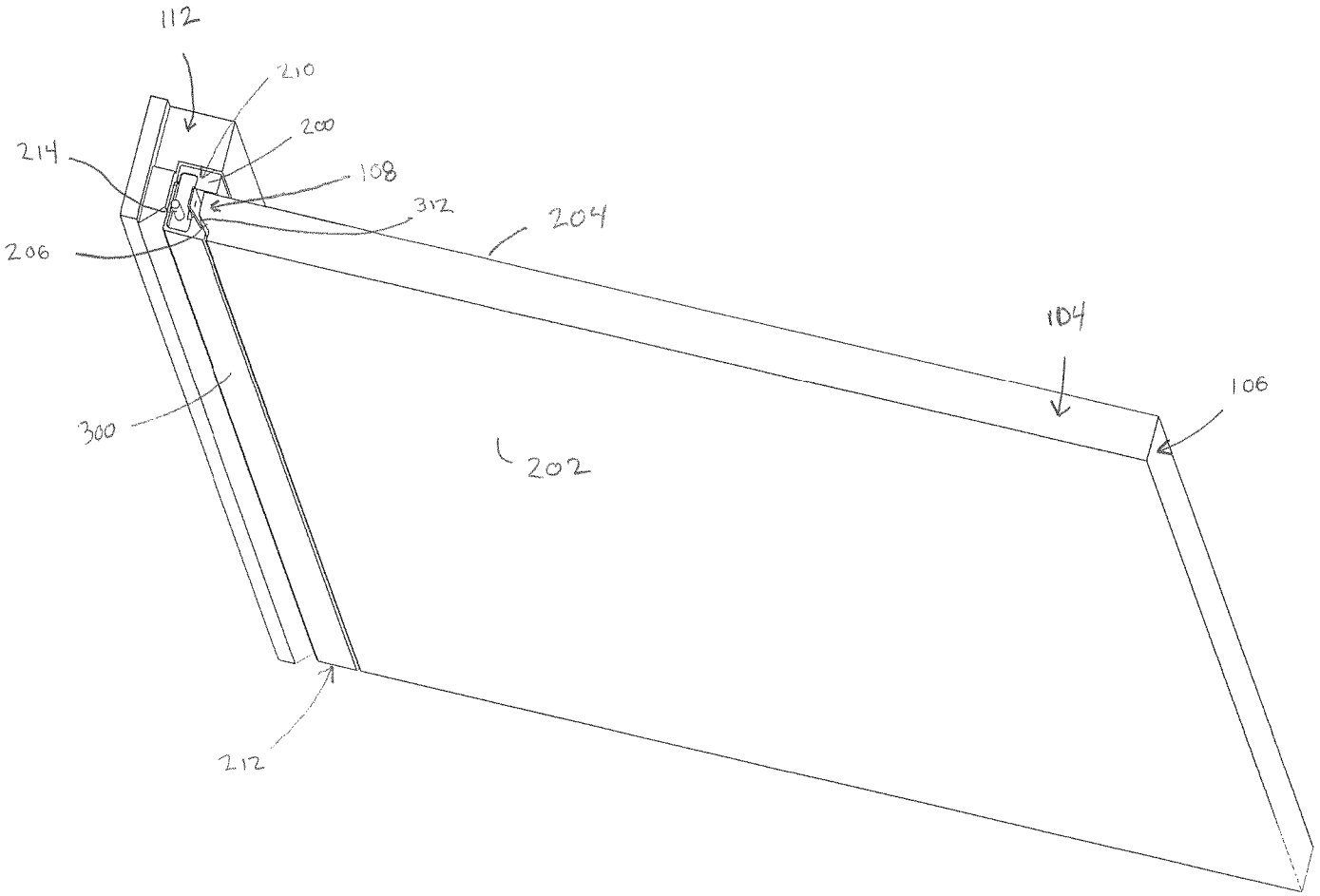
FIG. 2 is a partial perspective view of a door, securing member, and door frame of the FIG. 1.

Referring to FIG. 2, in an exemplary embodiment, the door assembly 100 also includes a securing member 200. The securing member 200 is movably mounted to the door frame 102 between a first position, in which the securing member is configured to engage and hold the door 104 in the closed position and prevent the door from moving to the open position, and a second position, in which the securing member releases the door to allow the door to be pivoted from the closed position to the open position. The securing member 200 can be configured in a variety of ways, such as, for example, various shapes, lengths, how and where it is mounted, and how it moves. Any configuration in which the securing member can, in one position, secure the door in the closed position to prevent the door from moving to the open position and in another position, release the door allowing it to move to the open position, may be used.

Figure 3:
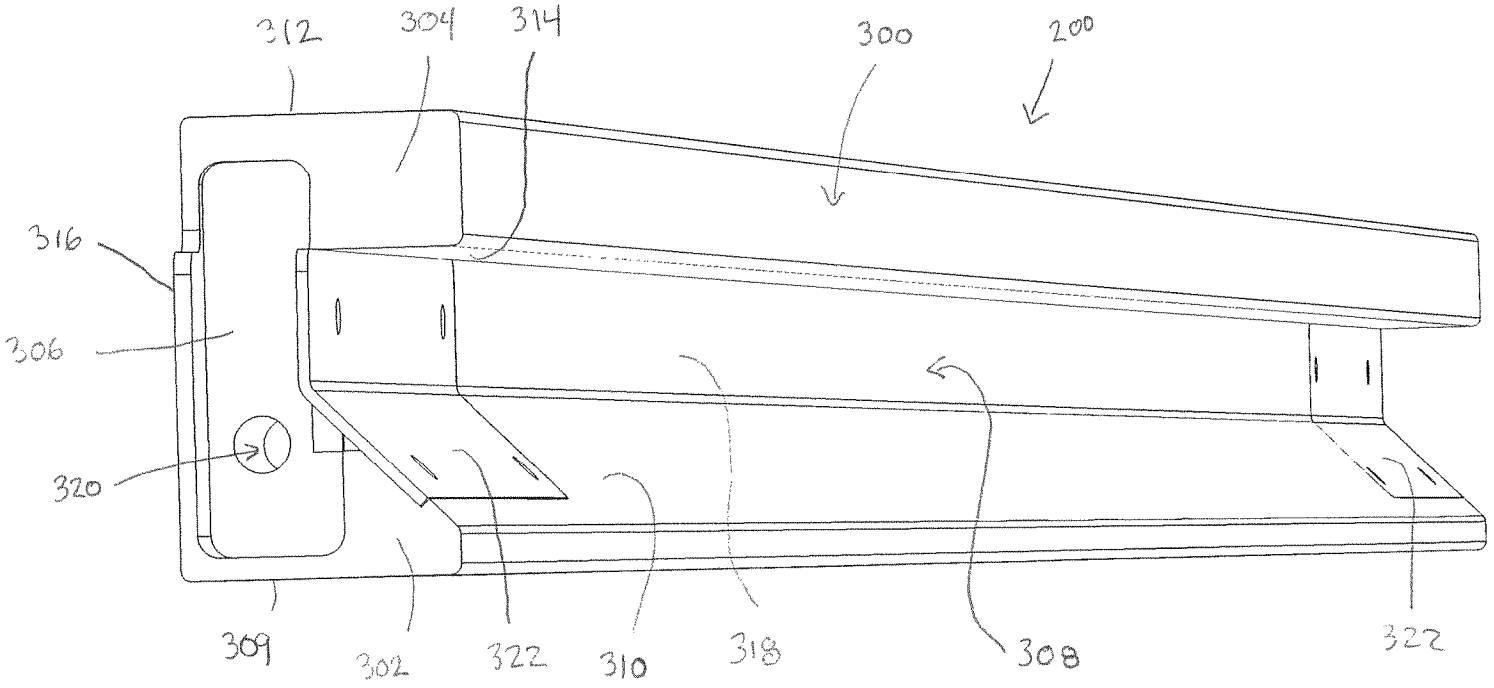
FIG. 3 is a perspective view of the securing member of FIG. 2.

Referring to FIGS. 2 and 3, in an exemplary embodiment, the securing member 200 has an elongated body 300 arranged generally between the first side section 112 and the door outer end portion 108, when the door is in the closed position. The securing member 200 extends along a height of the first side section 112 and engages the door outer end portion 108 along a height of the door 104, when the door is in the closed position. In an exemplary embodiment, the securing member 200 engages the door outer end portion 108 along a majority of the height of the door, though the securing member could engage the outer end portion along less than the majority. In another exemplary embodiment, the securing member 200 engages the outer end portion 108 of the door over substantially the entire height of the door.

In the exemplary embodiment of FIGS. 2 and 3, the securing member 200 is generally C-shaped. The C-shape configuration may extend along substantially the entire length of the securing member 200 or extend along a shorter portion of the securing member. The C-shaped configuration is formed by a first leg 302, a second leg 304, and an intermediate section 306 connecting the first leg to the second leg. The first leg 302, the second leg 304, and the intermediate section 306 form a channel 308 adapted to receive the outer end portion 108 of the door 104. The securing member 200 is still considered to have a general C-shape even if the first leg 302 and second leg 304 have different lengths, different shapes, or extend from the intermediate section 306 at different angles. In the exemplary embodiment, the securing member 200 has a first outer side surface 309, a first inner side surface 310, a second outer side surface 312, a second inner side surface 314, a third outer side surface 316 and a third inner side surface 318. The second outer side surface 308 is generally parallel to the second inner side surface 314 and the third outer side surface 316 is generally parallel to the third inner side surface 318. In the exemplary embodiment of FIGS. 2 and 3, however, the first inner side surface 310 is tapered with respect to the first outer side surface 308. In another exemplary embodiment, the first inner side surface 310 is generally parallel to the first outer side surface 308.

Referring to FIG. 2, in an exemplary embodiment, the door 104 has a first face 202 and a second face 204 that is generally parallel to the first face. The outer end portion 108 of the door 104 includes a tapered surface 206 that corresponds to the first inner surface 310 of the securing member 200. The securing member 200 may be configured to engage a first surface of the door 104 that faces in a first direction and a second surface of the door that faces in a direction that is greater than 90 degrees from the first direction. In the exemplary embodiment of FIG. 2, when the door 104 is in the closed position, the securing member 200 engages both the tapered surface 206 and the second face 204, which faces in a direction that is greater than 90 degrees from the tapered surface. The outer end portion 108 of the door and the corresponding surfaces on the securing member 106 adapted to interact the outer end portion of the door may be shaped in a variety of ways, such as, for example, the exemplary embodiments disclosed in FIGS. 18-20, of the present application, though other shapes and configurations may be used.

In an exemplary embodiment, the securing member 200 is pivotably mounted to the door frame 102. The securing member 200 may be pivotably mounted to the door frame 102 in a variety of ways. Any mounting configuration that allows the securing member to pivot from a first position, in which the securing member engages the door to hold the door in the closed position, and a second position, in which the securing member releases the door to allow the door to be pivoted from the closed position to the open position, may be used.

Figure 4:
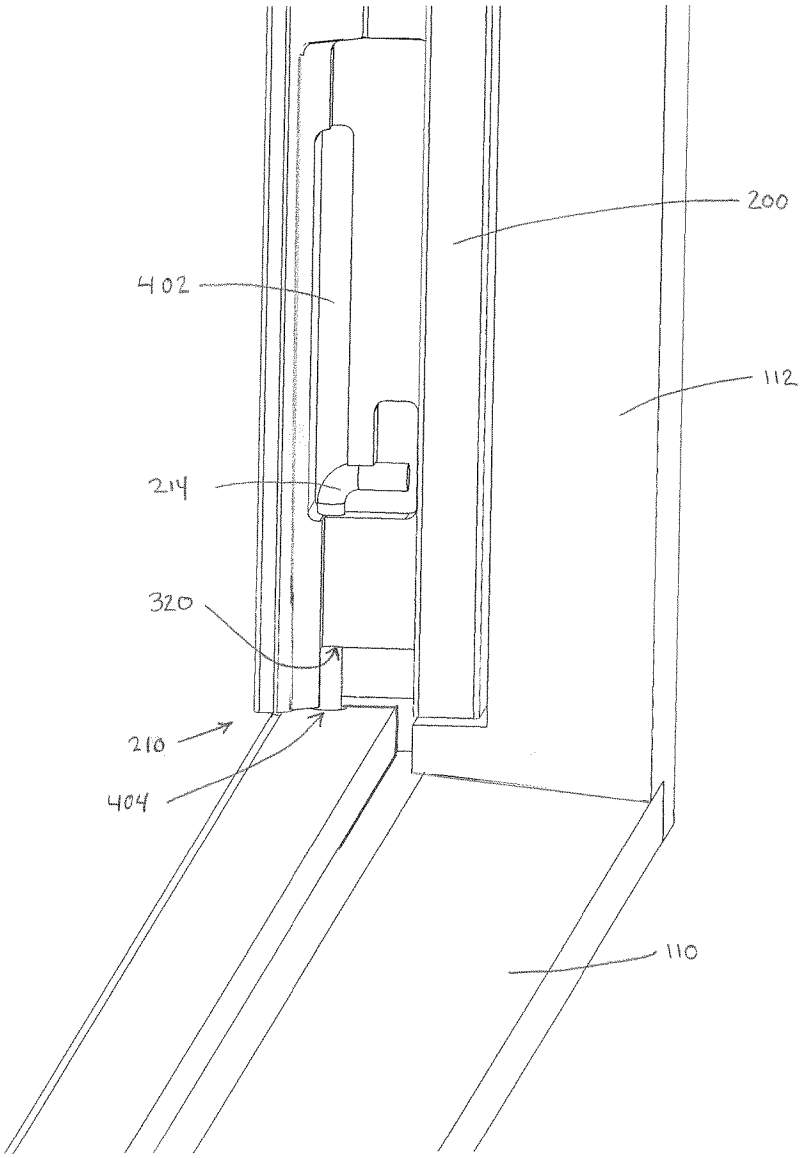
FIG. 4 is a partial perspective view of the door frame, securing member and sill section of the door assembly of FIG. 1.

Referring to FIGS. 3 and 4, the securing member 200 may be pivotably mounted at a first end 210 to the sill section 110 and at a second end 212 to the top section 116 by a pin 214 at each end and is configured to be supported by and pivot on the pins 214. In another exemplary embodiment, however, the first side section 112 may be configured to pivotably mount the securing member 200. As shown in FIGS. 3 and 4, each end 210, 212 of the securing member 200 may form a passage 320 configured to receive the pin 214. In an exemplary embodiment, the passage 320 is offset from a line that bisects the securing member 200. In other words, the securing member 200 pivots about a point that is offset closer to the first outer side surface 309 than to the second outer side surface 312. In other embodiments, however, the securing member 200 may pivot at a point closer to the second outer side surface 312 than the first outer side surface 309 or at a point generally equidistant between the first and second outer side surfaces.

Each end 210, 212 may also form a recess 402 in the channel 308 such that the pin 214 may be disposed in the recess 402, extend through the passage 320, and be received by a corresponding recess 404 in the sill section 110 or top section 116 of the door frame 102. The securing member 200 may include access panels 322 that may be removably secured to the securing member to cover the pins 214 and recesses 402 during use while also allowing access to the pins for service or replacement. The access panels 322 may be secured to the securing member 200 by any suitable means, such as fasteners, for example. A biasing member 406 may be configured and positioned to bias the securing member 200 to the second position. The biasing member may be configured and positioned in a variety of ways. In the illustrated embodiment, for example, the biasing member 406 is a torsion spring disposed about the longitudinal axis of at least one of the pins 214 such that a first end 408 of the spring is against the first side section 112 and a second end 410 of the spring is against the securing member 200.

Figure 5:
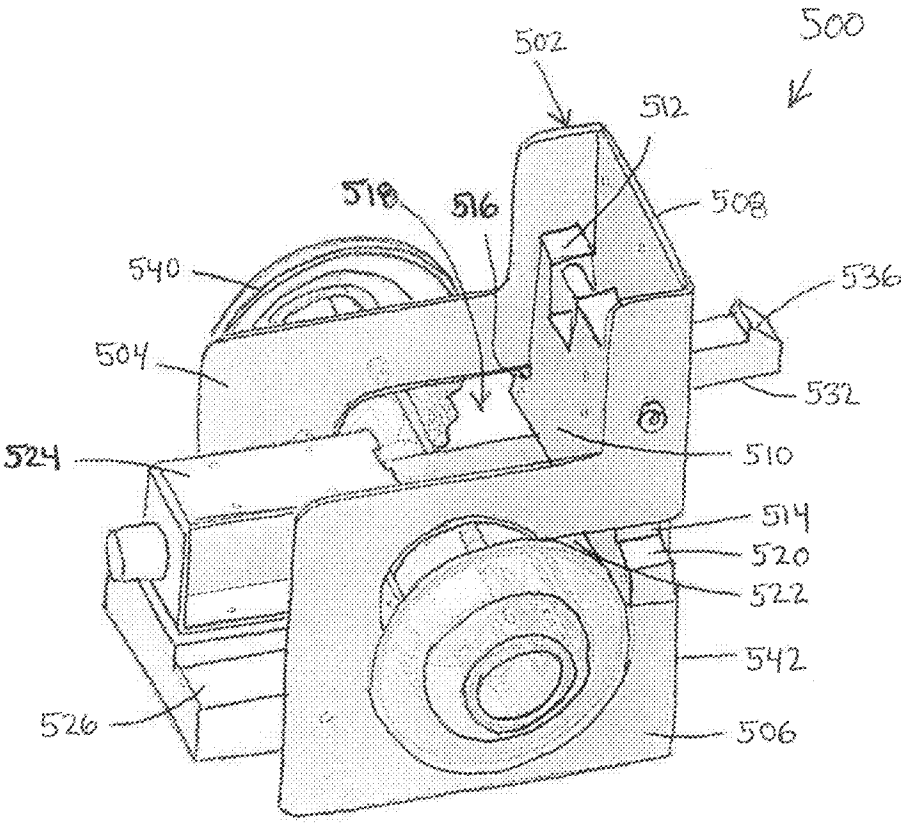
FIG. 5 is a perspective view of an exemplary embodiment of a latching assembly.
Figure 6:
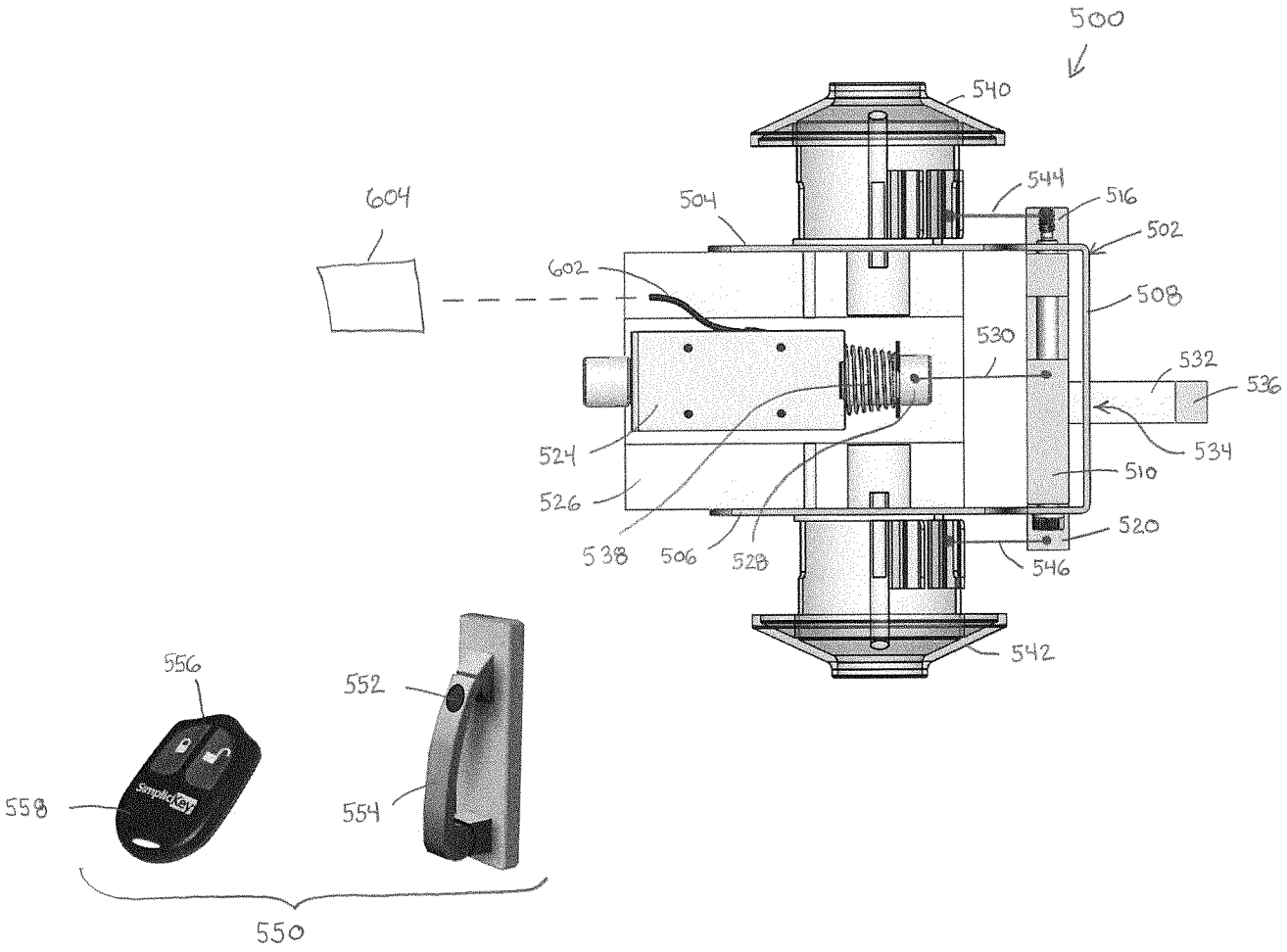
FIG. 6 is a top view of the latching assembly of FIG. 5.

Referring to FIGS. 5 and 6, in an exemplary embodiment, the door assembly 100 also includes a latching assembly 500. The latching assembly 500 is configured to, in a first state, hold the securing member 200 in the first position, and, in a second state, release the securing member 200 to allow the securing member to move from the first position to the second position. The latching assembly 500 can be configured in a variety of ways. For example, how and where the latching assembly engages the securing member, where the latching member is mounted, and how the latching member changes states, can vary. For example, in one exemplary embodiment, the latching assembly may be a mechanical system that is manually actuated to change the latching assembly between the first and second states. In another exemplary embodiment, the latching assembly includes one or more electrical components that facilitate the latching assembly changes states. In yet another exemplary embodiment, the latching assembly includes both electrical and mechanical components that facilitate the latching assembly changes states. Any latching assembly that can selectively hold the securing member in the first position and selectively release the securing member to move to the second position can be used.

In an exemplary embodiment, the latching assembly 500 includes a frame 502 having a first sidewall 504, a second sidewall 506 generally parallel to the first sidewall, and an third sidewall 508 connecting the first sidewall to the second sidewall. A lever block 510, having a first end section 512 and a second end section 514, is pivotably mounted by the first end section between the first sidewall 504 and the second sidewall 506 and generally adjacent the third sidewall 508. The second end section 514 of the lever block 510 may include a first projection 516 that extends outward from the lever block 510 and through a first passage 518 in the first sidewall section 504 and a second projection 520 that extends outward from the lever block 510 and through a second passage 522 in the second sidewall section 506.

The latching assembly 500 further includes a solenoid 524 mounted on a base portion 526 between the first sidewall section 504 and the second sidewall section 506. The solenoid 524 includes a movable plunger 528 operatively connected to the second end section 514 of the lever block 510 and movable between an extended position and retracted position. The plunger 528 may be operatively connected to the lever block 510 by any suitable manner. For example, the plunger 528 may be operatively connected to the lever block 510 by a first cable 530 or a rigid link.

The latching assembly 500 also includes a latching member 532. The latching member 532 is operatively connected to the lever block 510 such that the latching member pivots along with the lever block between a first position in which the latching member engages the securing member 200 and a second position, in which the latching member disengages with the securing member. The latching member can be connected to the lever block in a variety of ways. In the illustrated exemplary embodiment, the latching member 532 if fixably mounted directly to the lever block 510.

The latching member 532 extends outward from the lever block 510, in a direction away from the solenoid 524, through a passage 534 in the third sidewall 508. The latching member 532 is configured to engage the securing member 200. The latching member 532 can be configured to engage the securing member in a variety of ways. In the illustrated exemplary embodiment, the latching member 520 includes a hook portion 536. The latching member 532 may also be biased to the first position. In the exemplary embodiment, the solenoid 524 includes a spring 538 arranged to bias the plunger 528 to the extended position, and thus the latching member 532 to the first position.

Optionally, the latching assembly 500 may include multiple ways to move the latching member 532 between the first and second position. For example, the latching assembly 500 may include one or more turnable handles or knobs operatively coupled to the lever block 510, in place of or in addition to the solenoid 524. In an exemplary embodiment, a first handle 540 is rotatably mounted to the first sidewall section 504 and a second handle 542 is rotatably mounted to the second sidewall section 506. The first handle 540 is operatively coupled to the first projection 516 on the lever block 510 by a second cable 544 and the second handle 542 is operatively coupled to the second projection 520 on the lever block 510 by a third cable 546. In another exemplary embodiment, the first handle 540 and/or the second handle 542 may be arranged such that turning the first handle or the second handle results in a signal being sent, wirelessly or via hard wiring, to activate the solenoid 524. For example, the latching assembly 1302 (see discussion regarding FIG. 13) may be used to send a wireless signal in response to turning a handle.

The solenoid 524 is electrically coupled to a power source 604 by one or more wires 602 (see FIG. 6). Any power source capable of actuating the solenoid 524 may be used, such as, for example, household electricity. The solenoid 524 is also in operative communication with one or more user interfaces 550 which can be selectively engaged to activate and deactivate the solenoid. The user interface 550 can be any suitable interface accessible to the end-user. For example, the user interface could be one or more buttons, switches, triggers, or other actuatable devices mounted on the door frame 102, on the door 104, or at some other location. In one embodiment, the interface includes a button 552 disposed on a handle 554 mounted to the door 104 and configured to be in wireless communication with the latching assembly 500 to activate and deactivate the solenoid 524. In another embodiment, the interface 550 includes a button 556 on a hand-held remote 556 configured to be in wireless communication with the latching assembly 500 to activate and deactivate the solenoid 524.

Figure 7:
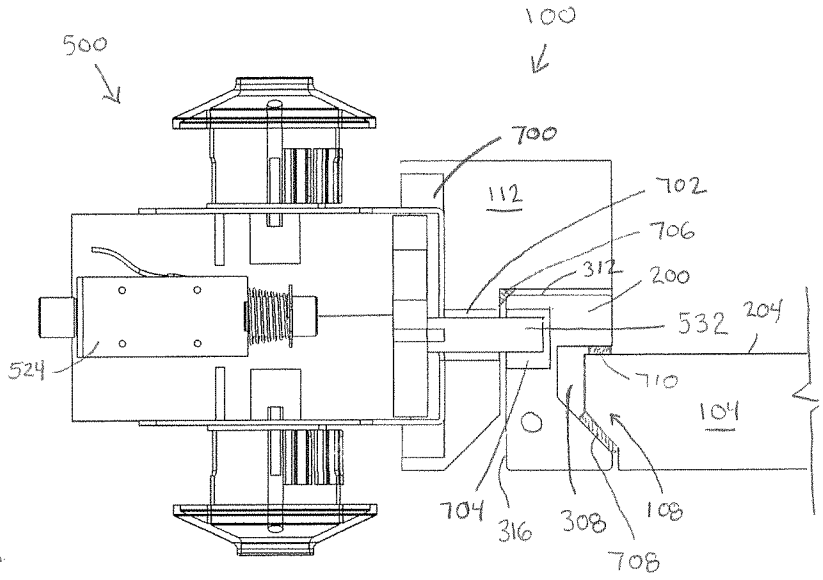
FIG. 7 is a partial sectional view of the door assembly of FIG. 1 with the door in the closed position.

Referring to FIG. 7, the door assembly 100 is depicted in a position in which the door 104 is in the closed position, the securing member 200 is in the first position, and the latching assembly 500 is in the first state, which means, for the illustrated exemplary embodiment, that the latching member 532 is in the first position. The latching assembly 500 is mounted to the first side section 112 at a mounting section 700. In the illustrated embodiment, the mounting section 700 is a recess configured to receive the latching assembly 500, but any suitable mounting section may be used. The latching assembly 500 may mount to the mounting section 700 by any suitable manner, such as fasteners, for example.

When the latching assembly 500 is mounted to the first side section 112, the latching member 532 extends through a first opening 702 in the first side section 112 and into a second opening or cavity 704 in the securing member 200. The cavity 704 may have a lip portion 800. When the latching member 532 is in the first position and the securing member 200 is in the first position, the hook portion 536 of the latching member 532 is adjacent the lip portion 800 such that the latching member 532 holds the securing member 200 in the first position. A first sealing member 706 may be disposed between the securing member 200 and the first side section 112. In the depicted embodiment, the first sealing member 706 is a corner seal that forms a seal between the first side section 112 and the a second outer side surface 312 and a third outer side surface 316 of the securing member 200. The first sealing member 706, however, can be configured and located in a suitable manner and location to provide a seal between the first side section 112 and the securing member 200 when the securing member is in the first position.

When the door 104 is in the closed position and the securing member 200 is in the first position, the door outer end portion 108 is at least partially received in the channel 308 of the securing member 200. In this position, the securing member 200 engages the door 104 along a height of the door to hold the door in the closed position and prevent the door from moving to the open position. In one embodiment, the securing member 200 engages the door 104 along a majority of the height of the door. In another embodiment, the securing member 200 engages the door 104 along substantially the entire height of the door.

When the door 104 is in the closed position and the securing member 200 is in the first position, the securing member 200 engages the door 104 on two surfaces that face away from each other. More specifically, the securing member 200 engages a first surface that faces in a first direction and engages a second surface the faces in a direction that is greater than 90 degrees from the first direction. In particular, in the illustrated exemplary embodiment the securing member 200 engages both the tapered surface 206 on the door outer end portion 108 and the second face 204. A second sealing member 708 is disposed between the tapered surface 206 on the door 104 and the first inner surface 312 of the securing member 200. In addition, a third sealing member 710 is disposed between the second face 204 and the second inner surface 314. The second sealing member 708 and the third sealing member 710, however, can be configured and located in any suitable manner and location to provide a seal between the securing member 200 and the door 104. For example, the sealing members 708, 710 can be located on the securing member 200, on the door 104, or on both. The securing members 708, 710 may extend along substantially the entire height of the securing member 200 or door 104 to provide a strong weather seal when the door is in a closed position. The first, second, and third sealing members 706, 708, 710, may be constructed of any suitable sealing material.

Figure 10:
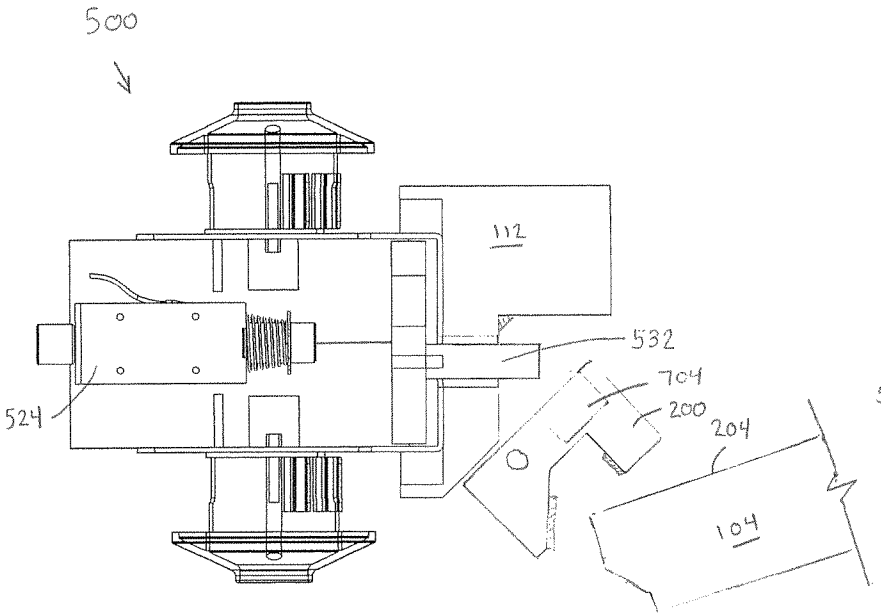
FIG. 10 is a partial sectional view of the door assembly of FIG. 1 with the door in the open position.
Figure 8:
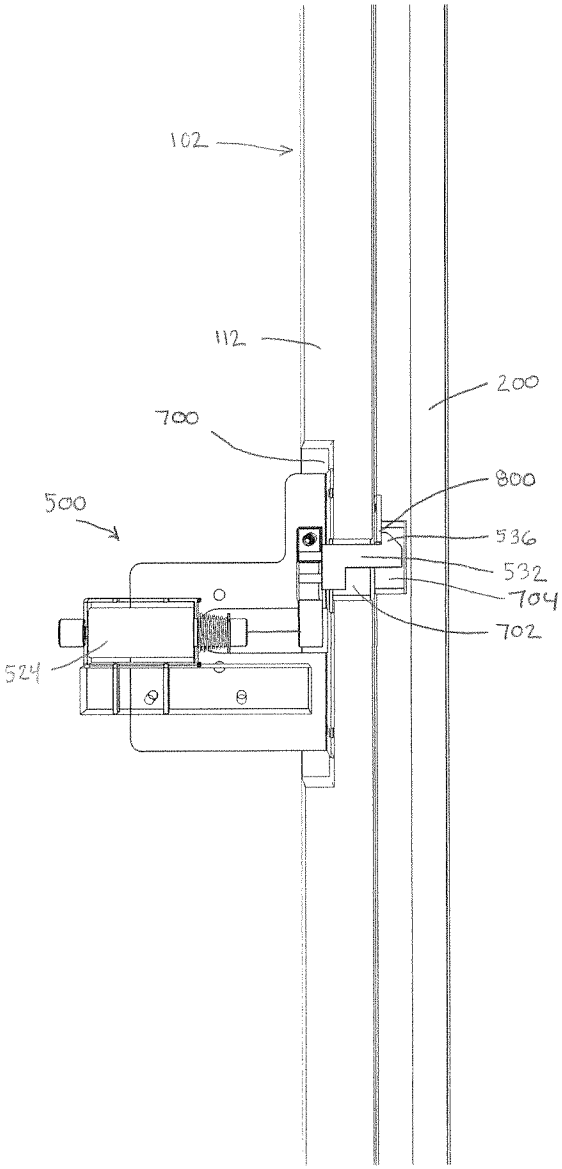
FIG. 8 is a sectional side view of the latching assembly of FIG. 5 in a first position installed in a door frame.
Figure 9:
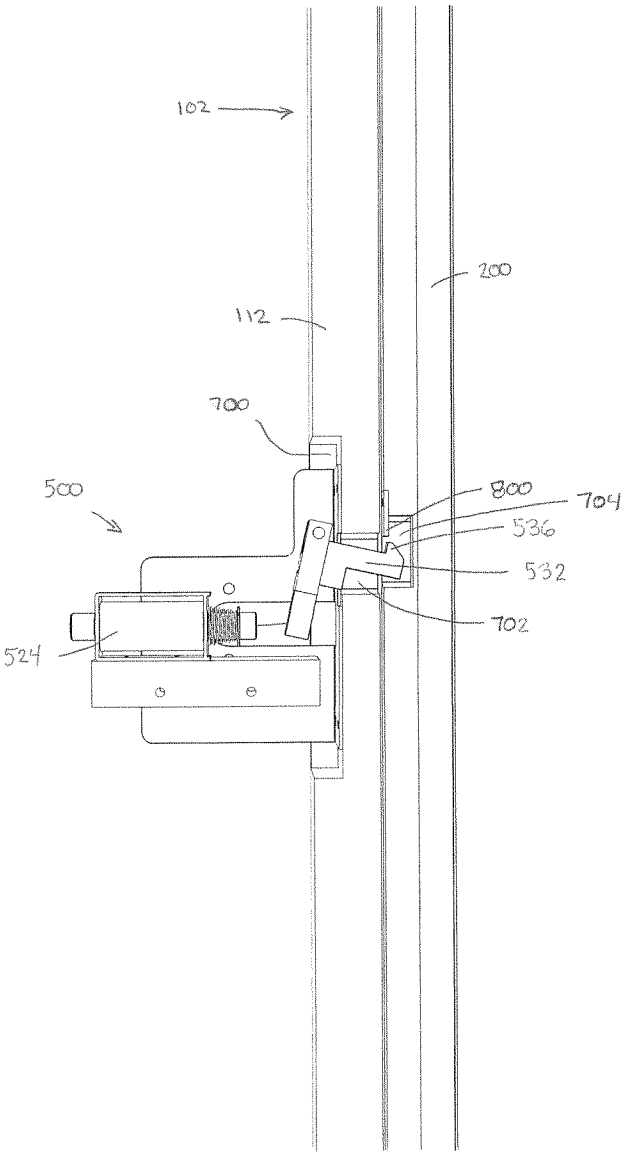
FIG. 9 is a sectional side view of the latching assembly of FIG. 5 in a second position installed in a door frame.

Referring to FIGS. 9 and 10, to release the door 104 and allow the door to be moved to the open position, the latching assembly 500 may be changed from the first state to the second state. In the depicted embodiment, the latching assembly 500 can be changed to the second state by activating the solenoid 524 or turning the first handle 540 or the second handle 542. The solenoid 524 can be activated via the interface 550. When activated, the plunger 528 of the solenoid 524 retracts resulting in the second end section 514 of the lever block 510 pivoting toward the solenoid 524. As a result, the latching member 532 moves to the second position which clears the hook portion 536 of the latching member 532 from the lip portion 806 of the opening or cavity 804. Similarly, turning the first handle 540 or the second handle 542 also results in the second end section 514 of the lever block 510 pivoting toward the solenoid 524, thus, clearing the hook portion 536 from the lip portion 806.

Referring to FIG. 10, when the latching assembly 500 is in the second state, which for the illustrated exemplary embodiment results in the latching member 532 being in the second position, the securing member 200 is released and free to move its second position. The biasing member 406 biases the securing member 200 to its second position. Since the securing member 200 is engaged with the second face 204 of the door 104 when in the first position and the door 104 is closed, when the securing member 200 is released, the biasing member 406 moves the securing member to the second position and the securing member moves the door 104 from the closed position to the open position. The open position refers to any position in which the door 104 pivots clear of the door frame 102. In this manner, the door assembly 100 is configured to present the door in an open position automatically once the latching assembly 500 is changed to the second state. In other embodiments, the securing member 200 may not be biased to the second position. In these embodiments, when the latching assembly 200 is changed to the second state, the door 104 is free to be manually opened, which results in the securing member 200 being moved to the second position by the door 104.

The latching member 532 may be biased to the first position. For example, in the illustrated exemplary embodiment, the spring 538 is arranged to bias the plunger 528 to the extended position. Due to the connection between the plunger 528 and the lever block 510, biasing the plunger to the extended position also biases the latching member 532 to the first position. The latching member 532 may, however, be moved to the second position when a suitable force is applied, such as when the door 104 closes causing the securing member 200 to pivot from the second position to the first position. The securing member 200 engages the latching member 532 and moves the latching member to the second position to allow the securing member to pass to the first position. Once the securing member 200 is in the first position, the latching member 532 returns to the first position under the bias of the spring 538

Figure 11:
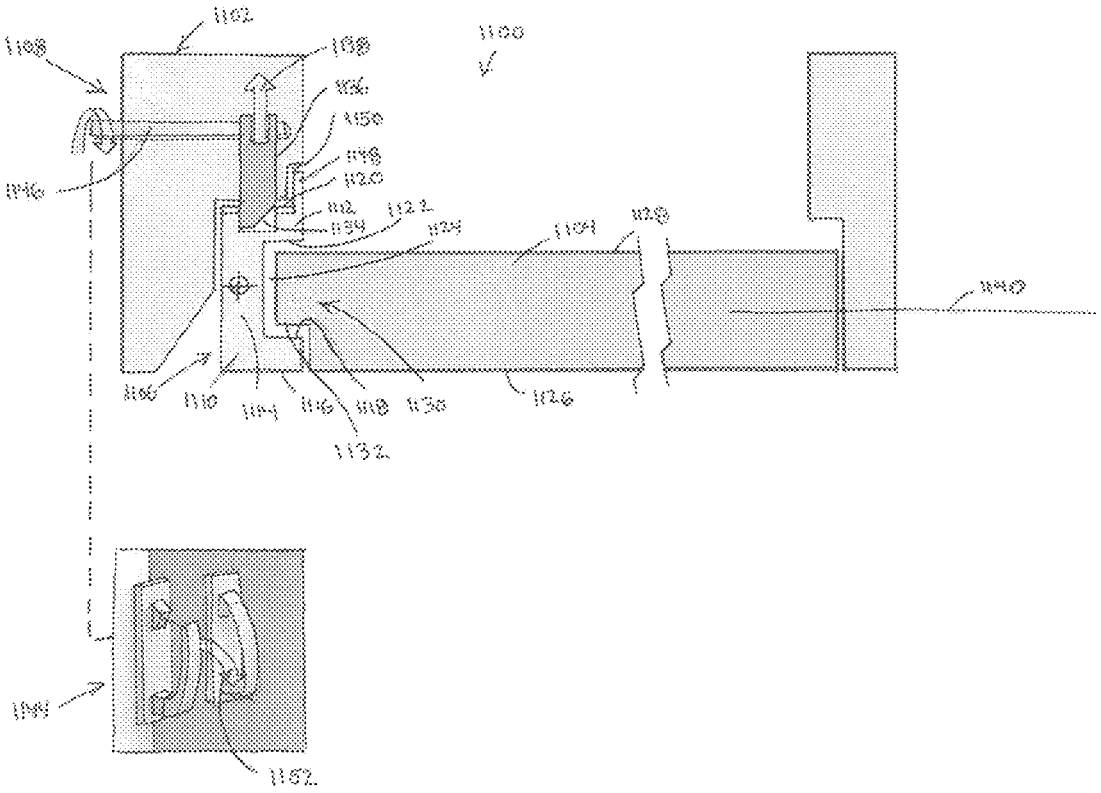
FIG. 11 is a graphical representation of a partial top view of an exemplary embodiment of a door assembly.

FIG. 11 illustrates an exemplary embodiment of a door assembly 1100 that is similar to the door assembly 100 in FIGS. 1-10 in that it includes a door frame 1102, a door

1104, a securing member 1106, and a latching assembly 1108. As with the embodiment of FIGS. 1-10, the door 1104 is pivotably coupled to the door frame 1104 such that the door is pivotable between an open position and a closed position. The securing member 1106 is movably mounted to the door frame 1102 between a first position, in which the securing member is configured to engage and hold the door 1104 in the closed position and prevent the door from moving to the open position, and a second position, in which the securing member releases the door to allow the door to be pivoted from the closed position to the open position. Furthermore, the latching assembly 1108 is mounted to the door frame 1104, wherein, in a first state, the latching assembly holds the securing member 1106 in the first position, and, in a second state, the latching assembly releases the securing member to allow the securing member to pivot from the first position to the second position.

In the illustrated exemplary embodiment in FIG. 11, however, the shape of the securing member 1106, the shape of the door 1104, and the latching assembly 1108 differ for the securing member 200, the door 104, and the latching assembly 500 of the embodiment of FIGS. 1-10. The securing member 1106 has a generally C-shape that may extend along substantially the entire length of the securing member 1106 or extend along a shorter portion of the securing member. The C-shaped configuration is formed by a first leg 1110, a second leg 1112, and an intermediate section 1114 connecting the first leg to the second leg. The first leg 1110 has a first outer side surface 1116 and a first inner side surface 1118 and the second leg 1112 has a second outer side surface 1120 and a second inner side surface 1122. The first inner side surface 1118 is generally parallel to the first outer side surface 1116. The first leg 1110, the second leg 1112, and the intermediate section 1114 form a channel 1124.

In illustrated exemplary embodiment, the door 1104 has a first face 1126, a second face 1128 that is generally parallel to the first face, and an outer end portion 1130. The outer end portion 1130 includes a rabbeted edge that forms a first surface 1132 that faces generally in the opposite direction as the second face 1128 of the door 1104. When the door 1104 is in the closed position, the outer end portion 1130 is at least partially received in the channel 1124 and the securing member 1106 engages both the first surface 1132 and the second face 1128.

The securing member 1106 has a recess 1134 formed in the second outer surface 1120 of the second leg 1112. The latching assembly 1108 includes a movable latching member 1136 that is movable between a first position, in the first state, in which the latching member extends into the recess 1134 to engage the securing member 1106 and hold the securing member in the first position, and a second position, in the second state, in which the latching member retracts from the recess to allow the securing member to pivot from the first position to the second position. As shown by an arrow 1138 in FIG. 11, the latching member 1136 moves between the first position and the second position in a direction generally perpendicular a longitudinal axis 1140 of the door 1104 when the door is in the closed position.

The latching assembly 1108 is configured to change between the first state and the second state. To switch states, the latching assembly 1108 may be configured in a variety of ways. Any configuration capable of selectively moving the latching member 1136 between the first position and the second position may be used. For example, the latching assembly 1108 can include a rack and pinion arrangement, a cam and follower arrangement, a lever and fulcrum arrangement, or other suitable arrangement. In the illustrated embodiment, the latching assembly 1108 includes an interface 1144 in the form of a pivotable handle mounted on the door frame 1102 or other suitable location. The latching assembly 1108, however, may include multiple interfaces, such as an interface mounted on either side of the door frame 1102, and other interface types, such as a trigger, a switch, a turnable handle, or other suitable interface. The handle 1144 is operatively connected to a rotatable spindle 1146 such that moving the handle 1144 in one direction results in rotating the spindle in one direction and moving the handle in a second direction results in rotating the spindle in a second direction. The spindle 1146 is operatively connected to the latching member 1136 via a rack and pinion type arrangement. Thus, rotating the spindle 1146 results in the latching member 1136 moving between the first and second positions.

The latching member 1136 may be biased to the first position by, for example, a spring or other suitable biasing member, and retract to the second position when a suitable force is applied to the latching member 1136, such as when the door 1104 closes causing the securing member 1106 to pivot from the second position to the first position and engage the latching member.

The securing member 1106 also includes a guard portion 1148. The door frame 1102 includes a rabbeted edge 1150 in which the guard portion 1148 is received when the securing member 1106 is in the first position. The guard portion 1148 is configured to restrict access to latching member 1136 from the area between the second outer surface 1120 and the door frame 1102.

In operation, the door assembly 1100 functions generally similar to door assembly 100. When the door 1104 is closed, the securing member 1106 is in the first position such that the door outer end 1130 is received in the channel 1124. When the latching assembly 1108 is in the first state, the latching member 1136 is in the first position and received in the recess 1134 of the securing member 1106. As a result, the latching member 1136 holds the securing member 1106 in the first position and the securing member engages the door 1104 along a height of the door to hold the door in the closed position and prevent the door from moving to the open position. When the latching assembly 1108 is changed to the second state and the latching member 1136 moves to the second position, a biasing member (not shown) similar to the biasing member 406, biases the securing member 1106 to the second position and the door 1104 is moved by the securing member 1106 from the closed position to the open position.

When the door 1104 is moved from the open position to the closed position, the door engages the securing member 1106, which is in the second position, and pivots the securing member to the first position while the door outer end portion 1130 is received in the channel 1124. As the securing member 1106 pivots to the first position, it engages the latching member 1136, which is in the first position, and moves the latching member to the second position. Once the securing member 1106 reaches the first position, the latching member 1136 is biased back to the first position and is received in the recess 1134.

Figure 12:
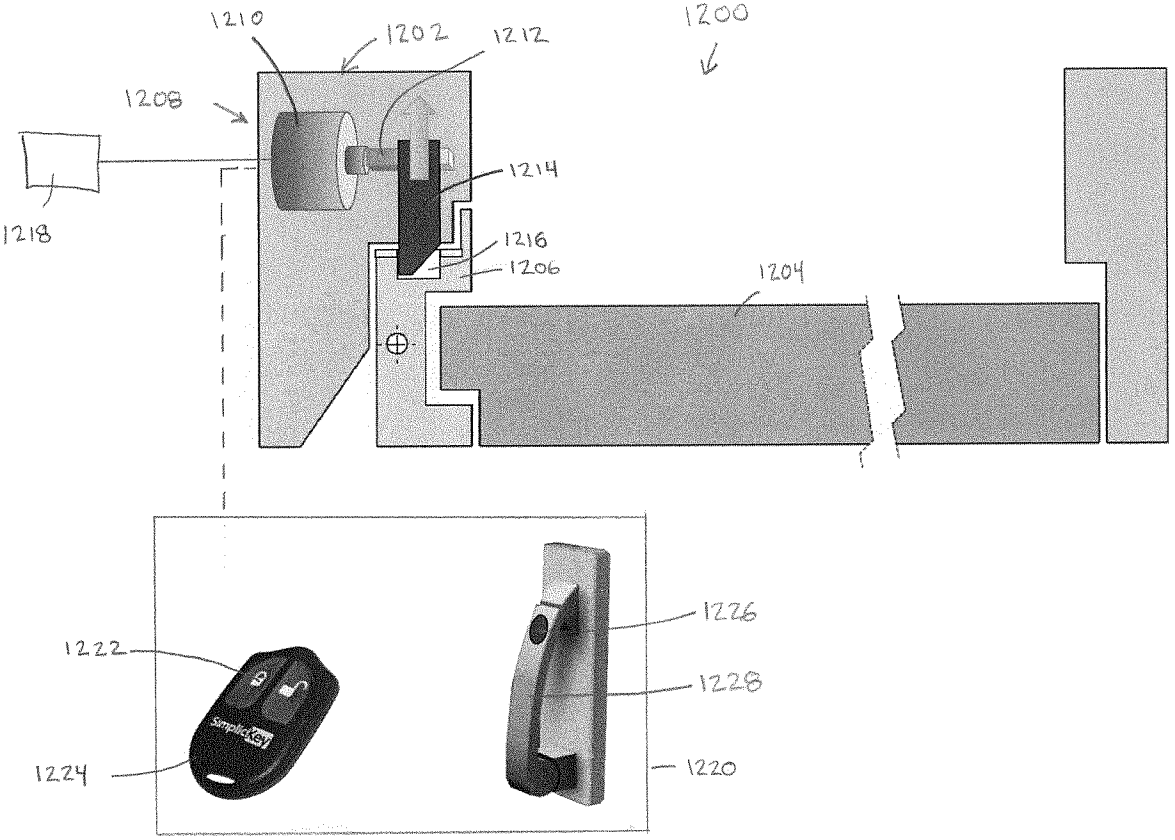
FIG. 12 is a graphical representation of a partial top view of an exemplary embodiment of a door assembly.

In the illustrated exemplary embodiment, to selectively move the latching member 1136 from the first position to the second position, the pivotable handle (interface) 1144 is pivoted in the direction of arrow 1152. As a result, the handle 1144 rotates the spindle 1146 and the latching member is moved in the direction of arrow 1138 to the second position, which releases the securing member 1106 to allow the securing member to pivot from the first position to the second position FIG. 12 illustrates an exemplary embodiment of a door assembly 1200 that is similar to the door assembly 1100 in FIG. 11 in that it includes a door frame 1202, a door 1204, a securing member 1206, and a latching assembly 1208. As with the embodiment of FIG. 11, the door 1204 is pivotably coupled to the door frame 1204 such that the door is pivotable between an open position and a closed position. In addition, the securing member 1206 is movably mounted to the door frame 1202 between a first position, in which the securing member is configured to engage and hold the door 1204 in the closed position and prevent the door from moving to the open position, and a second position, in which the securing member releases the door to allow the door to be pivoted from the closed position to the open position. Furthermore, the latching assembly 1208 is mounted to the door frame 1204, wherein, in a first state, the latching assembly holds the securing member 1206 in the first position, and, in a second state, the latching assembly releases the securing member to allow the securing member to pivot from the first position to the second position.

In the illustrated embodiment in FIG. 12, the latching assembly 1208 includes an electric motor 1210, such as a stepper motor or servo motor 1210 that is operatively connected to a rotatable spindle 1212. Similar to the latching assembly 1108 of FIG. 11, the rotatable spindle 1212 is operatively connected to a movable latching member 1214 via a rack and pinion type arrangement. Rotating the spindle 1212 results in the latching member 1214 moving between the first position, in which it is received in a recess 1216 on the securing member 1206, and a second position, in which it retracts from the recess and releases the securing member.

The electric motor 1210 is electrically coupled to a power source 1218 that is capable of powering the motor, such as, for example, household electricity. The latching assembly 1108 is configured to receive an input from one or more interfaces 1220 to activate/deactivate the motor 1210. The latching assembly 1108 may be configured in a variety of ways to receive the input and respond by activating/deactivating the motor 1210. For example, the motor 1210 itself may be configured to receive the signal and respond by turning on or a switch may be configured to receive the signal and route power to the motor. The one or more interfaces 1220 may include a button 1222 on a remote 1224 or a button 1226 on a handle 1228 that is mounted on the door frame 1202, the door 1204, or other suitable location.

In operation, the door assembly 1200 operates generally similar to the door assembly 1100 of FIG. 11, except that to move the latching member 1214 from the first position to the second position, the user activates the button 1222 on the remote 1224 or the button 1226 on the handle 1228. When activated, the remote 1224 or handle 1228 sends a wireless input that results in activating the motor 1210 to rotate the spindle 1212 which moves the latching member 1214.

Figure 13:
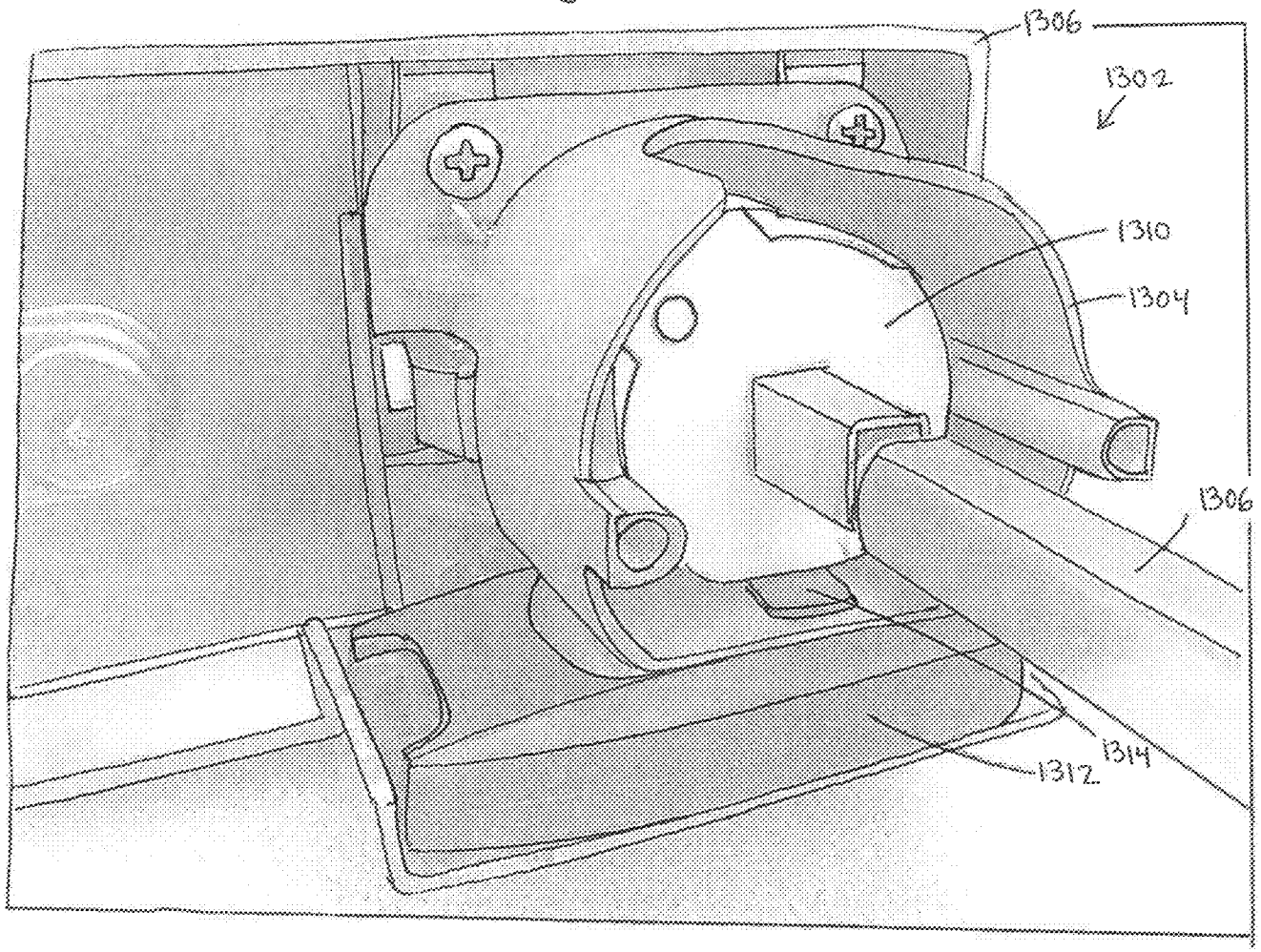
FIG. 13 is a perspective view of an exemplary embodiment of a latching assembly.

FIG. 13 illustrates another exemplary embodiment of a latching assembly 1302 for use on a door assembly as described in the present application, such as door assembly 1200 in FIG. 12, for example. The latching assembly 1302 can include a housing 1304 that is mounted to a bracket 1306. The bracket 1306 can mount to a door, door frame or other suitable location, or in some embodiments, the housing 1304 can mount directly to the door, the door frame, or other location and the bracket can be omitted. A rotatable spindle 1308 extends through the housing 1304 and out one or both sides of the housing. A cam 1310 is fixably mounted to the spindle such that rotation of the spindle rotates the cam. A remote 1312 having a button 1314 or other interface is mounted on the housing such that the button is adjacent the cam 1310. The remote 1312 is configured to send a wireless signal, similar to the wireless signal send by the remote 1224 and handle 1228 of the embodiment of FIG. 12. An interface (not shown) such as a handle, trigger, switch or other suitable interface is operatively connected to the spindle 1308.

To actuate the latching assembly 1302, the interface is engaged, such as for example, by turning a handle, which results in rotation of the spindle 1308 and the cam 1310. As the cam 1310 rotates, it depresses the button 1314 and the remote sends a wireless signal that switches the latching assembly 1302 between the first and second states.

Figure 14:
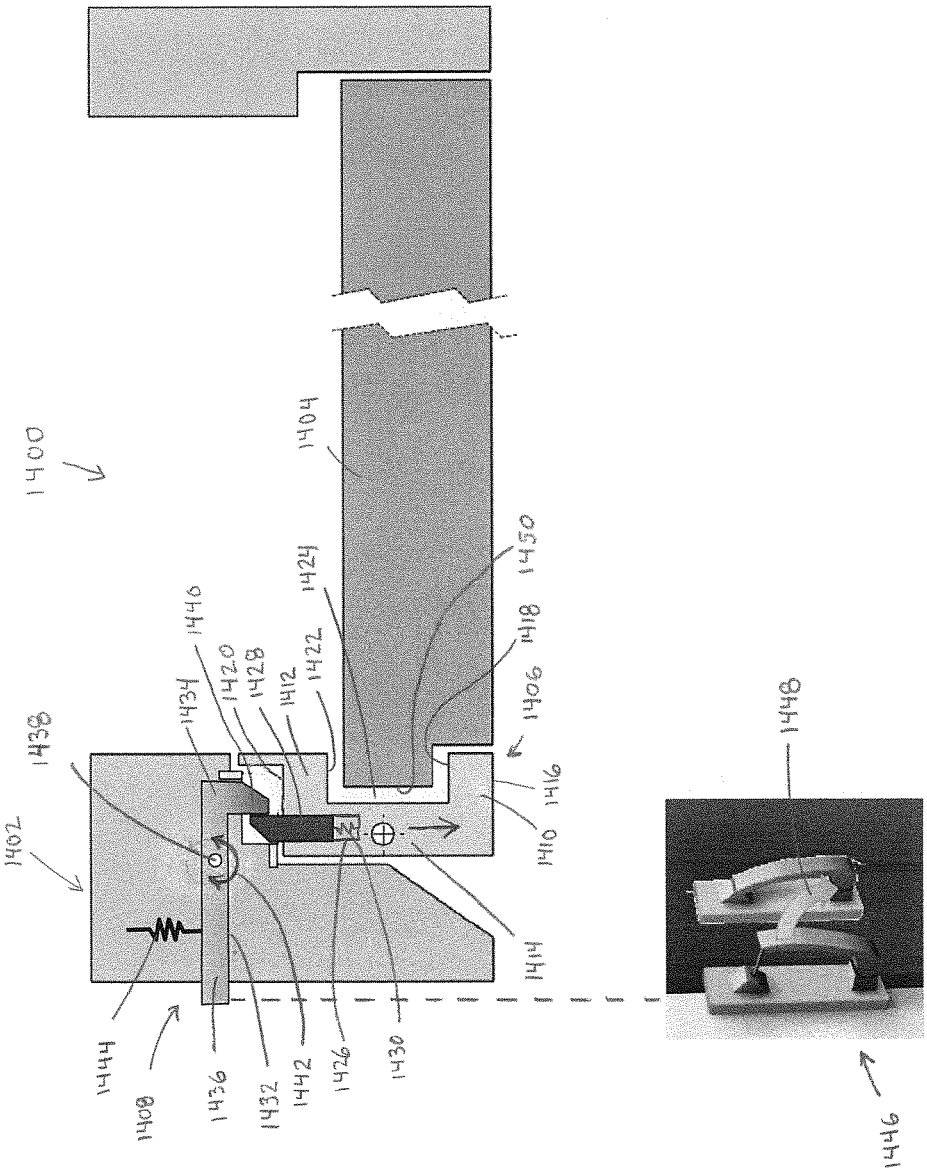
FIG. 14 is a graphical representation of a partial top view of an exemplary embodiment of a door assembly.

FIG. 14 illustrates an exemplary embodiment of a door assembly 1400 that is similar to the door assembly 1100 in FIG. 11 in that it includes a door frame 1402, a door 1404, a securing member 1406, and a latching assembly 1408. As with the embodiment of FIG. 11, the door 1404 is pivotably coupled to the door frame 1404 such that the door is pivotable between an open position and a closed position. In addition, the securing member 1406 is movably mounted to the door frame 1402 between a first position, in which the securing member is configured to engage and hold the door 1404 in the closed position and prevent the door from moving to the open position, and a second position, in which the securing member releases the door to allow the door to be pivoted from the closed position to the open position. Furthermore, the latching assembly 1408 is mounted to the door frame 1404, wherein, in a first state, the latching assembly holds the securing member 1406 in the first position, and, in a second state, the latching assembly releases the securing member to allow the securing member to pivot from the first position to the second position.

In the illustrated embodiment in FIG. 14, however, the securing member 1406 and the latching assembly 1408 differ from the securing member 1106 and the latching assembly 1108 of the embodiment of FIG. 11. The securing member 1406 has a generally C-shape along at least a portion of its length. The C-shape is formed by a first leg 1410, a second leg 1412, and an intermediate section 1414 connecting the first leg to the second leg. The first leg 1410 has a first outer side surface 1416 and a first inner side surface 1418 and the second leg 1412 has a second outer side surface 1420 and a second inner side surface 1422. The first inner side surface 1418 is generally parallel to the first outer side surface 1416. The first leg 1410, the second leg 1412, and the intermediate section 1414 form a channel 1424.

The securing member 1406 includes a cavity 1426 formed in the second outer side surface 1420. A movable plunger 1428 is disposed in the cavity 1426. The plunger 1428 is movable between a first position in which the plunger is extended relative to the cavity 1426 and a second position in which the plunger is retracted relative to the cavity. A biasing member 1430, such as a spring, may be arranged to bias the plunger 1428 to the first position.

In the illustrated embodiment of FIG. 14, the latching assembly 1408 includes a latching member 1432 having a first end 1434 and a second end 1436. The latching member 1432 is pivotable about a pivot point 1438 positioned between the first end 1434 and the second end 1436. The first end 1434 includes a hook portion 1440 configured to engage the plunger 1428 when the plunger is in the first position. The latching member 1432 is pivotable, as shown by arrow 1442 between a first position, corresponding to the first state of the latching assembly 1408, and a second position, corresponding to the second state of the latching assembly.

The latching assembly 1408 may include a biasing member 1444 configured to bias the latching member 1432 to the first position.

To switch between the first state and the second state, the latching assembly 1408 may be configured in a variety of ways. Any configuration capable of selectively moving the latching member 1432 between the first position and the second position may be used. In the illustrated embodiment, the latching assembly 1408 includes an interface 1446 in the form of a pivotable handle mounted on the door frame 1402 or other suitable location. The latching assembly 1408, however, may include multiple interfaces, such as an interface mounted on either side of the door frame 1402, and other interfaces types, such as a trigger, a switch, a turnable handle, or other suitable interface. The handle 1446 is operatively connected to the latching member 1432 such that pivoting the handle 1446 in the direction of arrow 1448 results in pivoting the latching member 1432 from the first position to the second position. When the handle 1146 is released, the biasing member 1444 biases the latching member to the first position.

In operation, the door assembly 1400 functions generally similar to door assembly 1100 of FIG. 11. When the door 1404 is closed, the securing member 1406 is in the first position such that an outer end portion 1450 of the door is received in the channel 1424 and the plunger 1428 is in the first position. When the latching assembly 1408 is in the first state, the latching member 1432 is in the first position adjacent to or engaging the plunger 1428. As a result, the latching member 1432 holds the securing member 1406 in the first position and the securing member engages the door 1404 along a height of the door to hold the door in the closed position and prevent the door from moving to the open position. When the latching assembly 1408 is changed to the second state, such as by pivoting the handle 1446 in the direction of arrow 1448, the latching member 1432 pivots to the second position and releases the securing member 1406 to allow the securing member to pivot from the first position to the second position. The securing member 1406 may pivot to the second position as a result of the door 1404 being manually opened or may be biased to the second position by a biasing member (not shown) similar to the biasing member 406 illustrated in FIGS. 1-10. The handle 1446 is released, the latching member 1432 may return to the first position under the bias of biasing member 1444.

When the door 1404 moves from the open position to the closed position, the door engages the securing member 1406, which is in the second position, and pivots the securing member to the first position while the door outer end portion 1450 is received in the channel 1424. As the securing member 1406 pivots to the first position, the plunger 1428 engages the latching member 1432, and both, or one of, the plunger and latching member move toward the second position against the bias of biasing member 1430 and biasing member 1444, respectively. The movement of one or both of the plunger 1428 and the latching member 1432 allow the securing member 1406 to complete its movement to the first position. Once the securing member 1406 reaches the first position, the plunger 1428 and the latching member 1436 are biased back to the first position.

Figure 15:
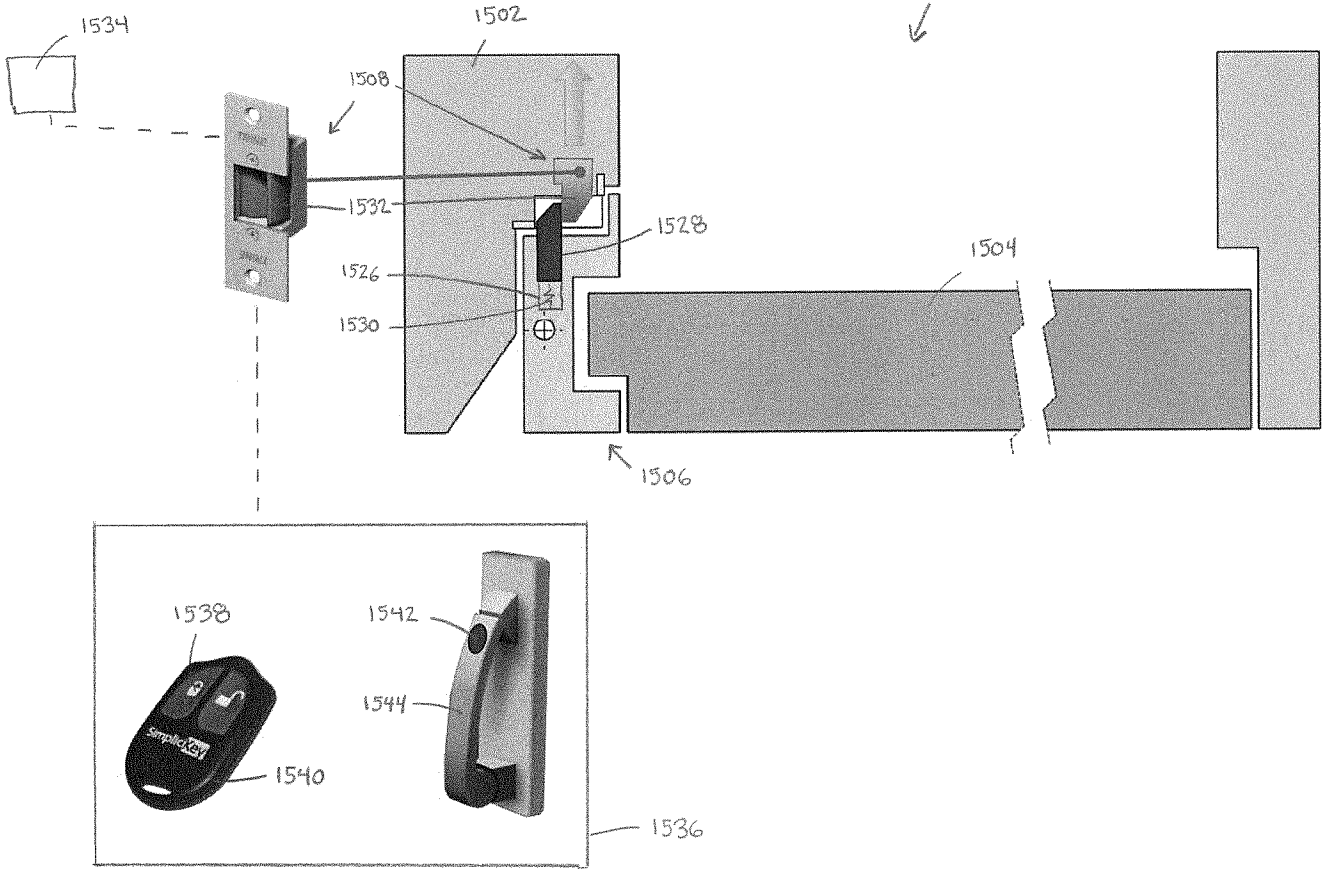
FIG. 15 is a graphical representation of a partial top view of an exemplary embodiment of a door assembly.

FIG. 15 illustrates an exemplary embodiment of a door assembly 1500 that is similar to the door assembly 1400 in FIG. 14 in that it includes a door frame 1502, a door 1504, a securing member 1506, and a latching assembly 1508. As with the embodiment of FIG. 15, the door 1504 is pivotably coupled to the door frame 1504 such that the door is pivotable between an open position and a closed position. In addition, the securing member 1506 is movably mounted to the door frame 1502 between a first position, in which the securing member is configured to engage and hold the door 1504 in the closed position and prevent the door from moving to the open position, and a second position, in which the securing member releases the door to allow the door to be pivoted from the closed position to the open position. Furthermore, the latching assembly 1508 is mounted to the door frame 1504, wherein, in a first state, the latching assembly holds the securing member 1506 in the first position, and, in a second state, the latching assembly releases the securing member to allow the securing member to pivot from the first position to the second position.

The securing member 1506 includes a cavity 1526 in which a movable plunger 1528 is disposed. The plunger 1528 is movable between a first position in which the plunger is extended relative to the cavity 1526 and a second position in which the plunger is retracted relative to the cavity. A biasing member 1530, such as a spring, may be arranged to bias the plunger 1528 to the first position.

In the illustrated embodiment in FIG. 15, the latching assembly 1508 includes a latching member 1532 configured to engage the plunger 1528. The latching member 1532 is movable between a first position, corresponding to the first state of the latching assembly 1508, and a second position, corresponding to the second state of the latching assembly. The latching member 1532 may be an electrically actuated device. In the illustrated embodiment, the latching member 1532 is an electric strike plate, which are known in the art, though other electrically actuated arrangements can be used which move a latching member between the first and second positions.

The latching member 1532 is electrically coupled to a power source 1534, such as household electricity, that is capable of actuating the latching member. The latching member 1532 is configured to receive an input from one or more interfaces 1536. The one or more interfaces 1536 may include, for example, a button 1538 on a remote 1540 or a button 1542 on a handle 1544 that is mounted on the door frame 1502, the door 1504, or other suitable location.

In operation, the door assembly 1500 operates generally similar to the door assembly 1400 of FIG. 14, except that to move the latching member 1532 from the first position to the second position, the user activates the button 1538 on the remote 1540 or the button 1542 on the handle 1544. When activated, the remote 1540 or handle 1544 sends a wireless input that is configured to result in the latching member 1532 moving between the first and second positions.

Figure 16:
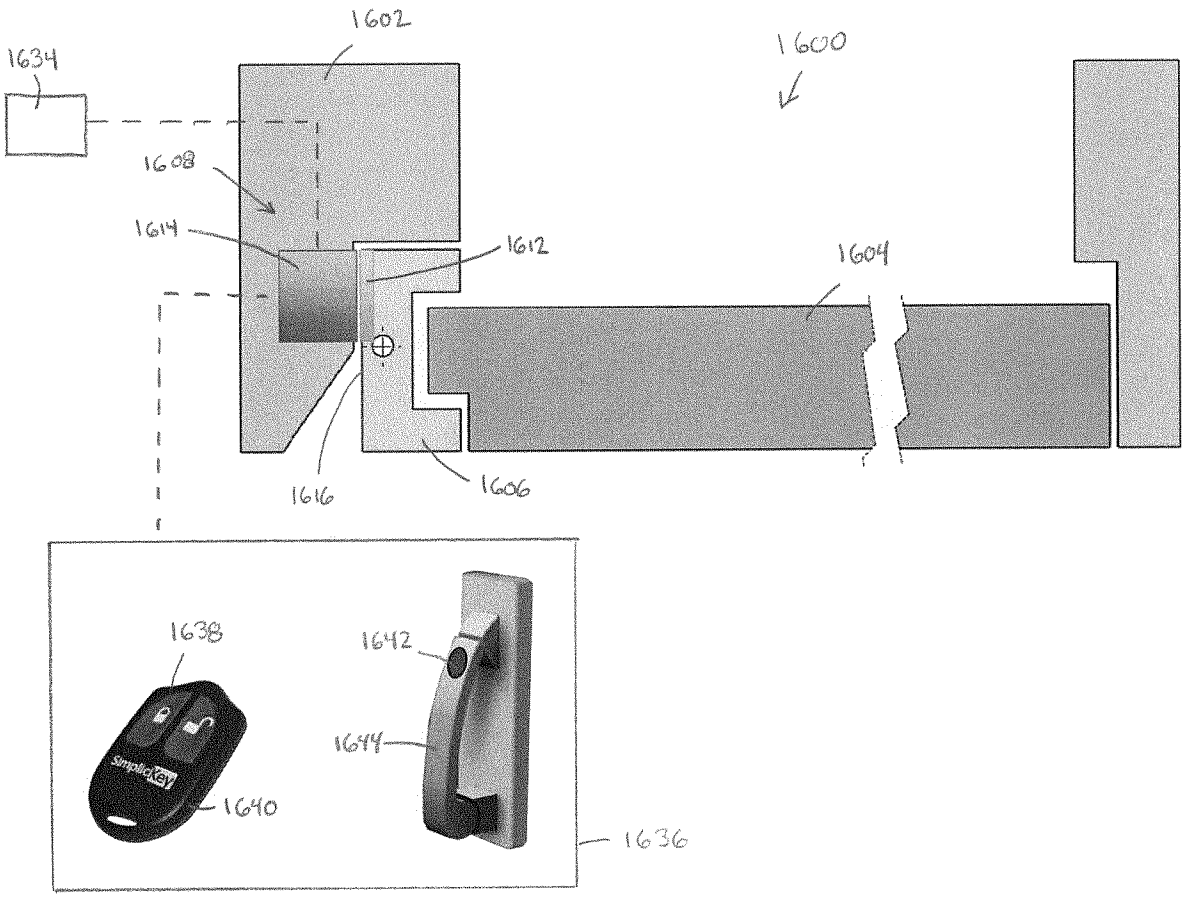
FIG. 16 is a graphical representation of a partial top view of an exemplary embodiment of a door assembly.

FIG. 16 illustrates an exemplary embodiment of a door assembly 1600 that is similar to the door assembly 1400 in FIG. 14 in that it includes a door frame 1602, a door 1604, a securing member 1606, and a latching assembly 1608. As with the embodiment of FIG. 16, the door 1604 is pivotably coupled to the door frame 1604 such that the door is pivotable between an open position and a closed position. In addition, the securing member 1606 is movably mounted to the door frame 1602 between a first position, in which the securing member is configured to engage and hold the door 1604 in the closed position and prevent the door from moving to the open position, and a second position, in which the securing member releases the door to allow the door to be pivoted from the closed position to the open position. Furthermore, the latching assembly 1608 is mounted to the door frame 1604, wherein, in a first state, the latching assembly holds the securing member 1606 in the first position, and, in a second state, the latching assembly releases the securing member to allow the securing member to pivot from the first position to the second position.

In the illustrated embodiment, the securing member 1606 includes an armature plate 1612 and the latching assembly 1608 includes an electromagnet 1614. The armature plate 1612 may be mounted on an outer surface 1616 of the securing member 1606 and the electromagnet 1614 may be mounted on the door frame 1602 at a location adjacent the armature plate 1612 when the securing member 1606 is in the first position. The armature plate 1612 and the electromagnet 1614, however, can be mounted in any location that allows the electromagnet to magnetically couple to the armature plate to hold the securing member 1606 in the first position.

The electromagnet 1614 is electrically coupled to a power source 1634 that is capable of energizing the electromagnet, such as, for example, household electricity. The electromagnet 1614 is configured to be actuated by an input from one or more interfaces 1636. The one or more interfaces 1636 may include a button 1638 on a remote 1640 or a button 1642 on a handle 1644 that is mounted on the door frame 1602, the door 1604, or other suitable location.

In operation, the door assembly 1600 operates generally similar to the door assembly 1400 of FIG. 14, except that to change the latching assembly 1608 from the second state to the first state, the user activates the button 1638 on the remote 1640 or the button 1642 on the handle 1644. When activated, the remote 1640 or handle 1644 sends a wireless input that results in energizing the electromagnet 1614. As a result, the electromagnet 1614 changes to the first state and creates a magnetic field that magnetically couples the armature plate 1612 with sufficient force to hold the securing member 1606 in the first position.

Figure 17:
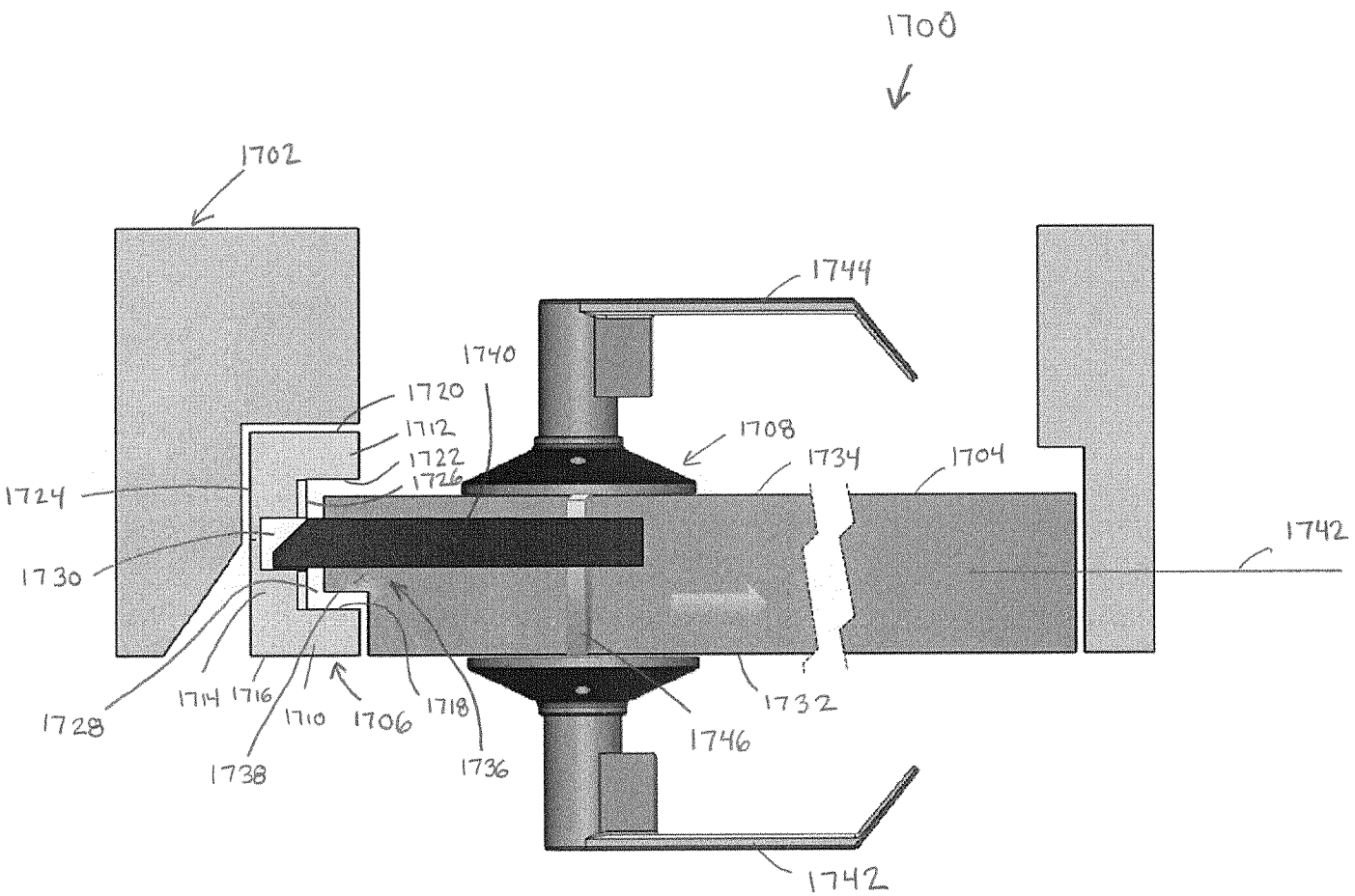
FIG. 17 is a graphical representation of a partial top view of an exemplary embodiment of a door assembly.

FIG. 17 illustrates an exemplary embodiment of the door assembly 1700 that is similar to the door assembly 1100 of FIG. 11 in that it includes a door frame 1702, a door 1704, a securing member 1706, and a latching assembly 1708. As with the embodiment of FIG. 11, the door 1704 is pivotably coupled to the door frame 1704 such that the door is pivotable between an open position and a closed position. In addition, the securing member 1706 is movably mounted to the door frame 1702 between a first position, in which the securing member is configured to engage and hold the door 1704 in the closed position and prevent the door from moving to the open position, and a second position, in which the securing member releases the door to allow the door to be pivoted from the closed position to the open position. Furthermore, the latching assembly 1708, in a first state, holds the securing member 1706 in the first position, and, in a second state, releases the securing member to allow the securing member to pivot from the first position to the second position.

In the illustrated embodiment of FIG. 17, however, the latching assembly 1708 is mounted in the door 1704 rather than the door frame 1702. The securing member 1706 has a generally c-shape that may extend along substantially the entire length of the securing member 1706 or extend along a shorter portion of the securing member. The C-shaped configuration is formed by a first leg 1710, a second leg 1712, and an intermediate section 1714 connecting the first leg to the second leg. The first leg 1710 has a first outer side surface 1716 and a first inner side surface 1718, the second leg 1712 has a second outer side surface 1720 and a second inner side surface 1722, and the intermediate section 1714 has a third outer side surface 1724 and third inner side surface 1726. The first inner side surface 1718 is generally parallel to the first outer side surface 1716. The first leg 1710, the second leg 1712, and the intermediate section 1714 form a channel 1728. A cavity 1730 is formed on the third inner side surface 1726. In the depicted embodiment, the cavity 1726 is generally equidistance between the first leg 1710 and the second leg 1712, but in other embodiment, the cavity need not be equidistant.

In illustrated embodiment, the door 1704 has a first face 1732, a second face 1734 that is generally parallel to the first face, and an outer end portion 1736. The outer end portion 1736 includes a rabbeted edge that forms a first surface 1738 that faces generally in the opposite direction as the second face 1734 of the door 1704. When the door 1704 is in the closed position, the outer end portion 1736 is at least partially received in the channel 1728 and the securing member 1706 engages both the first surface 1738 and the second face 1734.

The latching assembly 1708 includes a movable latching member 1740 disposed in the door 1704 and movable in the direction of a longitudinal axis 1742 of the door between a first position corresponding to the first state of the latching assembly, and a second position, corresponding to the second state of the latching assembly.

To switch states, the latching assembly 1708 may be configured in a variety of ways. Any configuration capable of selectively moving the latching member 1740 between the first position and the second position may be used. For example, the latching assembly 1708 can include a rack and pinion arrangement, a cam and follower arrangement, a lever and fulcrum arrangement, an electrically actuated arrangement, such a stepper or servo motor activated by a wireless input from an interface, or other suitable arrangement. In the illustrated embodiment, the latching assembly 1708 includes an interface in the form of a first turnable handle 1742 mounted on the first face 1732 of the door 1704 and a second turnable handle 1744 mounted on the second face 1734 of the door. A spindle 1746 connects the first handle 1742 to the second handle 1744 such that turning either handle will turn the spindle and the other handle. The spindle 1746 is operatively connected to the latching member 1740 such that rotation of the spindle moves the latching member between the first and second positions. For example, the spindle 1746 and the latching member 1740 may form a rack and pinion type of connection where rotation of the spindle 1746 results in axial movement of the latching member 1740.

The latching member 1740 may be biased to the first position by, for example, a spring or other suitable biasing member, and retract to the second position when a suitable force is applied to the latching member 1740, such as when the door 1704 closes and the outer end portion 1736 of the door 1704 engages the securing member 1706.

In operation, when the door 1704 is closed, the securing member 1706 is in the first position such that the door outer end portion 1736 is received in the channel 1728. When the latching assembly 1708 is in the first state, the latching member 1740 is in the first position and received in the cavity 1728 of the securing member 1706. As a result, the latching member 1740 holds the securing member 1706 in the first position because the door 1704 is prevented from pivoting from the closed position to the open position without moving the latching member to the second position. The securing member 1706 cannot pivot when the latching member 1740 is in the first position and received in the cavity 1730.

To change the latching assembly 1708 to the second state, the first handle 1742 or the second handle 1744 are turned, resulting in the latching member 1740 moving to the second position. In the second position, the latching member 1740 is retracted from the cavity 1730 to allow the securing member 1706 to pivot from the first position to the second position. The securing member 1706 may pivot to the second position as a result of the door 1704 being manually opened or may be biased to the second position by a biasing member (not shown) similar to the biasing member 406 illustrated in FIGS. 1-10. If the later, the securing member 1706 moves the door 1704 from the closed position to the open position. Once the first handle 1742 or second handle 1744 is released, the latching member 1740 may return to the first position under the bias of a biasing member (not shown).

When the door 1704 is moved from the open position to the closed position, the door engages the securing member 1706, which is in the second position, and pivots the securing member to the first position while the door outer end portion 1736 is received in the channel 1728. Once the securing member 1706 reaches the first position, the latching member 1740 is biased to the first position and is received in the cavity 1730.

Figure 18:
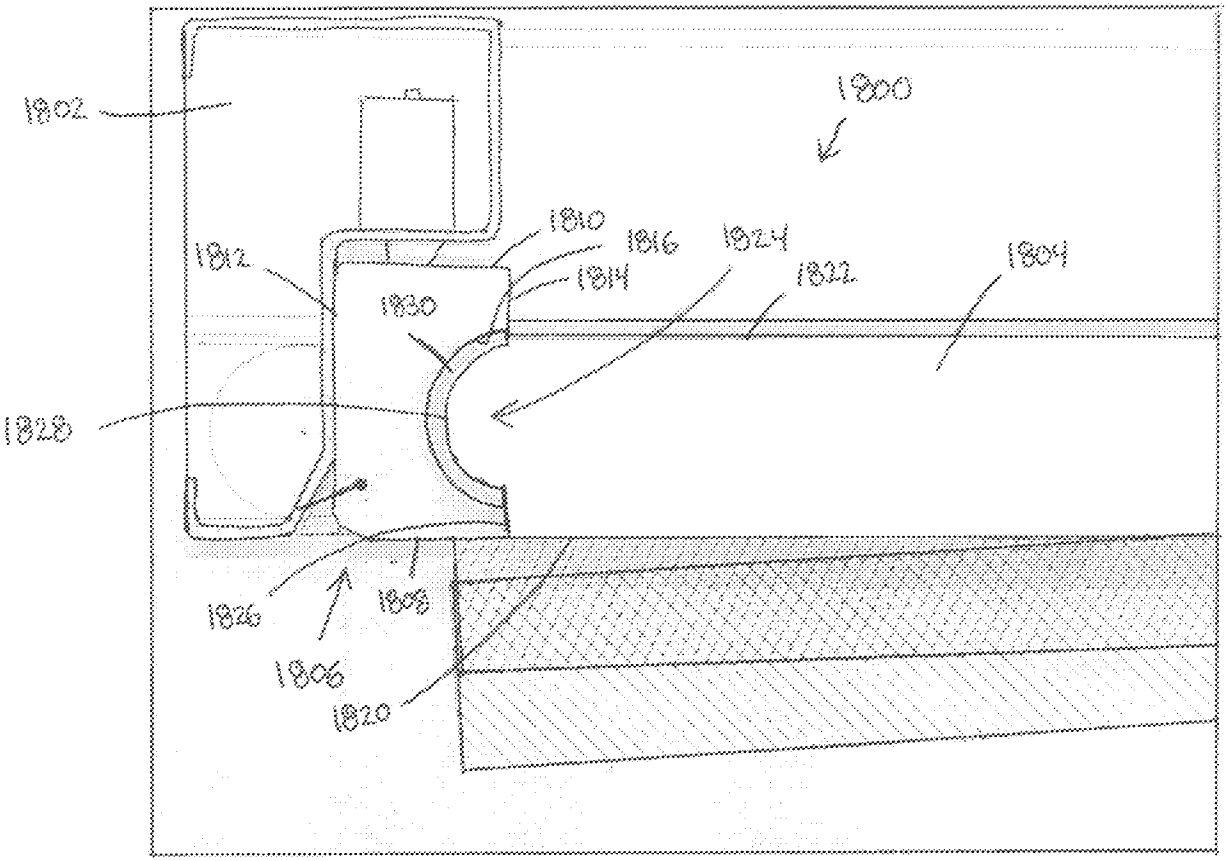
FIG. 18 is a graphical representation of a partial top view of an exemplary embodiment of a securing member and door.
Figure 19:
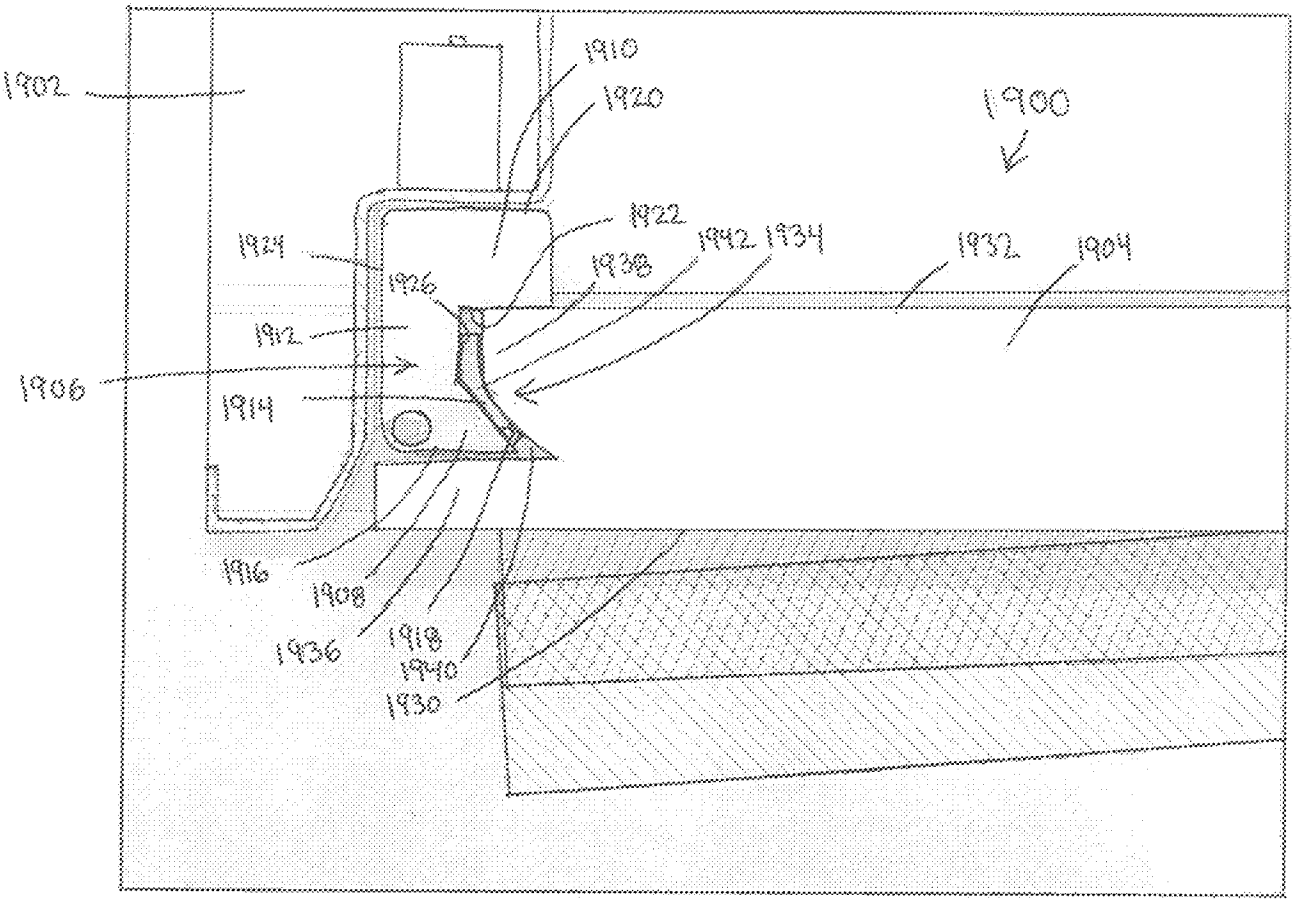
FIG. 19 is a graphical representation of a partial top view of an exemplary embodiment of a securing member and door.
Figure 20:
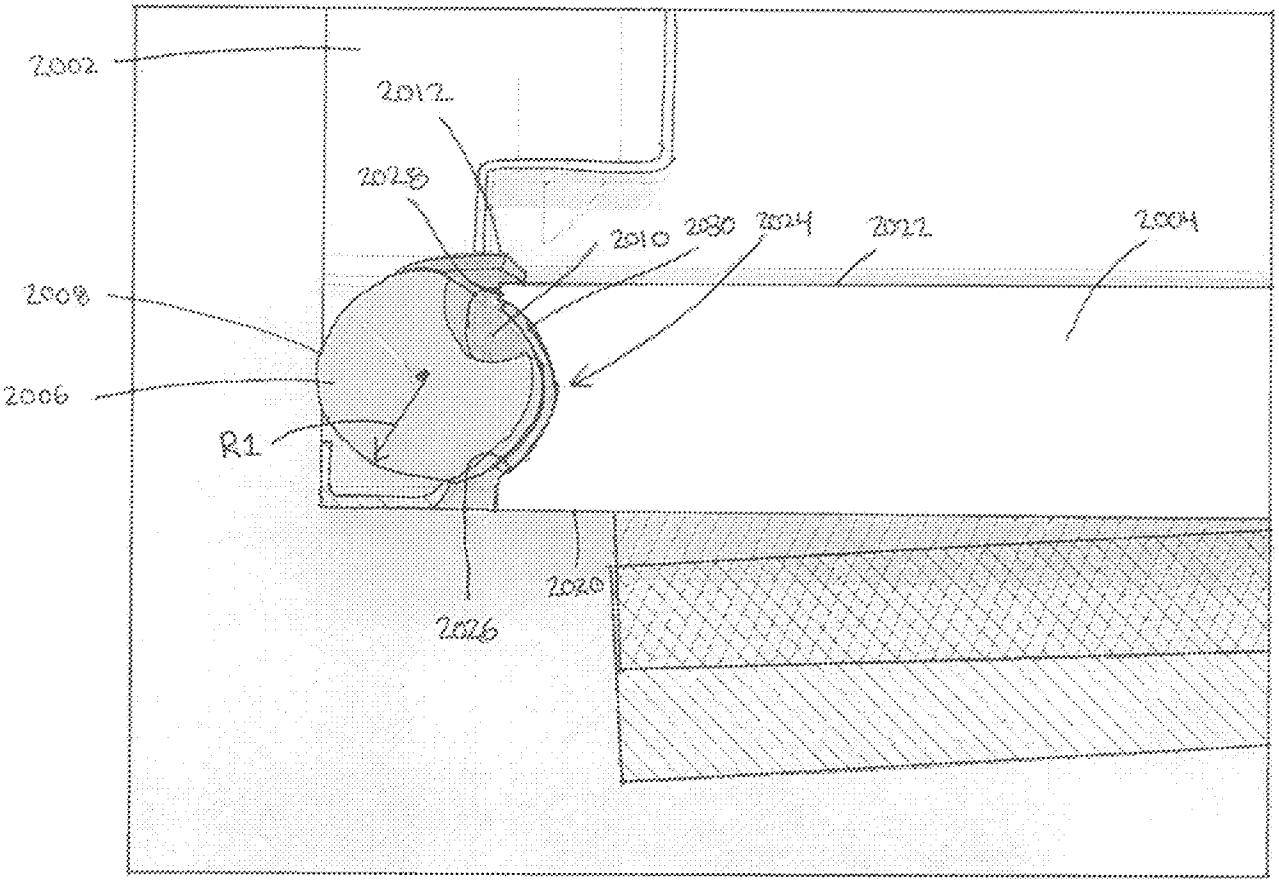
FIG. 20 is a graphical representation of a partial top view of an exemplary embodiment of a securing member and door.

FIGS. 18-20 illustrate exemplary embodiments of securing members and doors for door assemblies that are similar to the door assemblies of FIGS. 1-17. FIGS. 18-20 do not illustrate latching assemblies, however, one of skill in the art will understand that one or more of the latching assembly configurations described with respect to the exemplary embodiments disclosed in FIGS. 1-17 may be used with the door assemblies of FIGS. 18-20. For example, the securing members may include a recess or cavity similar to the securing member 200 (FIGS. 7-10), securing member 1106 (FIG. 11), and securing member 1206 (FIG. 12) for receiving a latching member from latching assembly similar to latching assemblies 500, 1108, and 1208, respectively. As further example, the securing members may include a movable plunger similar to the movable plunger 1428 (FIG. 14) for engaging a latching member from a latching assembly similar to latching assembly 1408 or latching assembly 1508 or an armature plate for engaging an electromagnet similar to the embodiment in FIG. 16.

FIGS. 18-20 illustrate that the shape and configuration of the outer end portion of the door and the securing member may vary in different exemplary embodiments. The embodiments in FIGS. 18-20 are exemplary and not intended to limit in any way the potential shapes and configurations that the securing member and the outer end portion of the door may take.

FIG. 18 illustrates an exemplary embodiment of the door assembly 1800 that includes a door frame 1802, a door 1804, and a securing member 1806. The door 1804 is pivotably coupled to the door frame 1802 such that the door is pivotable between an open position and a closed position. The securing member 1806 is movably mounted to the door frame 1802 between a first position, in which the securing member is configured to engage and hold the door 1804 in the closed position and prevent the door from moving to the open position, and a second position, in which the securing member releases the door to allow the door to be pivoted from the closed position to the open position.

In the illustrated embodiment, the securing member 1806 has a first side surface 1808, and second side surface 1810 that is generally parallel to the first side surface, a third side surface 1812, and a fourth side surface 1814 which is generally parallel to the third side surface and generally perpendicular to the first side surface and second side surface. The concave channel 1816 is formed in the fourth side surface 1814. The concave channel 1816 is illustrated as having a generally constant radius of curvature and is offset (e.g. closer to the first side surface than the second side surface) on the fourth side face. In other embodiments, however, the channel need not be offset or have a constant radius of curvature.

The door 1804 has a first face 1820, a second face 1822, and an outer end portion 1824. The outer end portion 1824 includes a first surface 1826 and a convex surface 1828 configured to be received in the channel 1816. In the illustrated embodiment, the convex surface 1828 has a generally constant radius if curvature that generally matches the radius of curvature of the channel, however, in other embodiments the convex surface need not have a constant radius or generally match the radius of the channel 1816. A sealing member 1830 is disposed in the concave channel 1816. In the depicted embodiment, the sealing member 1830 is a half-shell covers substantially the entire concave channel 1816, though in other embodiments, the sealing member may cover less than substantially the entire channel. In other embodiments, the sealing member 1830 may be positioned on one or more of the fourth side surface 1814, the first surface 1826 or the convex surface 1828.

When the door 1804 is in the closed position, the convex surface 1828 is received in the channel 1816, the first surface 1820 is adjacent the fourth side surface 1814. The sealing member 1830 forms a seal between the securing member 1806 and the door 1804.

FIG. 19 illustrates an exemplary embodiment of the door assembly 1900 that includes a door frame 1902, a door 1904, and a securing member 1906. The door 1904 is pivotably coupled to the door frame 1902 such that the door is pivotable between an open position and a closed position. The securing member 1906 is movably mounted to the door frame 1902 between a first position, in which the securing member is configured to engage and hold the door 1904 in the closed position and prevent the door from moving to the open position, and a second position, in which the securing member releases the door to allow the door to be pivoted from the closed position to the open position.

In the illustrated embodiment, the securing member 1906 has a generally C-shape configuration may extend along substantially the entire length of the securing member 1906 or extend along a shorter portion of the securing member. The C-shaped configuration is formed by a first leg 1908, a second leg 1910, and an intermediate section 1912 connecting the first leg to the second leg. The first leg 1908 does not extend as far from the intermediate section 1912 as the second leg 1910. The configuration, however, is still considered to be C-shaped. The first leg 1908, the second leg 1910, and the intermediate section 1912 form a channel 1914. The securing member 1906 has a first outer side surface 1916, a first inner side surface 1918, a second outer side surface 1920, a second inner side surface 1922, a third outer side surface 1924 and a third inner side surface 1926. The second outer side surface 1920 and the third outer side surface 1924 are generally parallel with the second inner side surface 1922 and the third inner side surface 1926, respectively. The first inner side surface 1918, however, is tapered with respect to the first outer side surface 1916.

The door 1904 has a first face 1930, a second face 1932, and an outer end portion 1934. The outer end portion 1934 includes a first section 1936, a second section 1938, and a recess 1940 between the first section 1936 and the second section 1940. When the door 1904 is in the closed position, the first section 1936 extends along and overlaps a portion of the first outer side surface 1916 of the securing member 1906. In addition, the first leg 1908 of the securing member

1906 is received in the recess 1940 of the outer end portion 1934 and the second section 1938 of the outer end portion is received in the channel 1914 of the securing member. In one embodiment, the first section 1936 overlaps all, or mostly all, of the first outer side surface 1916. As a result, when the door 1904 is in the closed position and viewed from the side facing the first face 1930 of the door, the securing member 1906 is hidden, or mostly hidden, by the first section 1936 of the door so that the securing member is not visible, or mostly not visible. A sealing member 1942 may be disposed on the securing member 1906 or on the door outer end portion 1934 to form seal between the sealing member and the door 1904 when the door is closed.

FIG. 20 illustrates an exemplary embodiment of the door assembly 2000 that includes a door frame 2002, a door 2004, and a securing member 2006. The door 2004 is pivotably coupled to the door frame 2002 such that the door is pivotable between an open position and a closed position. The securing member 2006 is movably mounted to the door frame 2002 between a first position, in which the securing member is configured to engage and hold the door 2004 in the closed position and prevent the door from moving to the open position, and a second position, in which the securing member releases the door to allow the door to be pivoted from the closed position to the open position.

In the illustrated embodiment, the securing member 2006 is generally cylindrical along substantially its entire length or, in other embodiments, along less than substantially its entire length. The securing member 2006 has a curved outer surface 2008 having a radius R1 and a concave channel 2010 formed in the outer surface. The securing member 2006 also includes a projection 2012 extending tangentially from the outer surface 2008 generally adjacent the channel 2010.

The door 2004 has a first face 2020, a second face 2022, and an outer end portion 2024. The outer end portion 2024 includes a concave recess 2026 and an edge portion 2028 positioned between the concave recess and the second face 2022. The concave recess 2026 may have a radius R2 substantially equal to the radius R1 of the outer surface 2008 of the cylindrical securing member 2006. In other embodiments, however, the radius of curvature R1 of the recess 2026 does not necessarily need to be substantially equal to radius of curvature R2 of the securing member 2006. A sealing member 2030 may be disposed in the concave recess 2026, along the outer surface 2008, or both. In the depicted embodiment, the sealing member 2030 is a half-shell that covers substantially the entire concave recess 2026, though in other embodiments, the sealing member may cover less than substantially the entire recess.

In operation, when the door 2026 is in the closed position, the securing member 2006 is received within the concave recess 2026 and the sealing member 2030 forms a seal between recess and the curved outer surface 2008 of the sealing member. In the closed position, the securing member 2006 is hidden, or mostly hidden, by the door 2026. The concave channel 2010 of the securing member 2006 is generally facing the edge portion 2028 of the door 2004 and the projection 2012 is adjacent, and in some embodiments engaging, the second face 2022 of the door.

For the door 2004 to move to the open position, the securing member 2006 is released and moved to the second position. The securing member 2006 may be released by, for example a latching assembly and may be moved to the second position by, for example a biasing member as described in the embodiments of FIGS. 1-17. If biased to the second position by a biasing member, the projection 2012 engages the second face 2022 of the door and moves the door from the closed position to the open position. If not biased by a biasing member, the door 2004 can be manually moved to the open position. As a result, while pivoting the door to the open position, the edge portion 2028 of the outer end portion 2024 of the door 2004 interacts with the concave channel 2010 causing the securing member 2006 to pivot from the first position to the second position.

When the door 2004 moves from the open position to the closed position, the edge portion 2028 of the door is received in the concave channel 2010 of the securing member and the second face 2022 of the door engages the projection 2012. As a result, the door 2004 pivots the securing member 2006 from the second position to the first position as the door completes moving to the closed position.

The above description of specific embodiments has been given by way of example. From the disclosure given, those skilled in the art will not only understand the general inventive concepts and attendant advantages, but will also find apparent various changes and modifications to the structures and methods disclosed. For example, the general inventive concepts are not typically limited to any particular door assembly application. Thus, for example, use of the inventive concepts to both residential and commercial structures, vehicles, appliances, or any applications where a door needs to be secured in a closed position are within the spirit and scope of the general inventive concepts. Furthermore, although various embodiments are described in detail, in view of the accompanying drawings, those skilled in the art will understand that aspects and elements of one exemplary embodiment can be used or modified for use with other embodiments and should not be construed as limited to the embodiments set forth herein. It is sought, therefore, to cover all such changes and modifications as fall within the spirit and scope of the general inventive concepts, as described and claimed herein, and equivalents thereof.

What is claimed is:

1. A door assembly, comprising:

a door frame including a first side section, a second side section, and a top section connecting the first and second side sections;

a door coupled to the second side section such that the door is pivotable between a closed position and an open position, the door having a height;

a securing member pivotably mounted to the door frame, wherein the securing member extends along a height of the first side section, and wherein the securing member is pivotable between a first position, in which the securing member engages the door along a majority of the height of the door to hold the door in the closed position and prevent the door from moving to the open position, and a second position, in which the securing member releases the door to allow the door to be pivoted from the closed position to the open position; and a latching assembly mounted to the first side section, wherein, in a first state, the latching assembly holds the securing member in the first position, and, in a second state, the latching assembly releases the securing member to allow the securing member to pivot from the first position to the second position;

wherein the securing member is generally cylindrical and includes a channel adapted to receive an outer end portion of the door when the door pivots from the open position to the closed position, and wherein the outer end portion includes a concave recess adapted to receive the securing member.

2. A door assembly, comprising:

a door frame including a first side section, a second side section, and a top section connecting the first and second side sections;

a door coupled to the second side section such that the door is pivotable between a closed position and an open position, the door having a height;

a securing member pivotably mounted to the door frame, wherein the securing member extends along a height of the first side section, and wherein the securing member is pivotable between a first position, in which the securing member engages the door along a majority of the height of the door to hold the door in the closed position and prevent the door from moving to the open position, and a second position, in which the securing member releases the door to allow the door to be pivoted from the closed position to the open position; and a latching assembly mounted to the first side section, wherein, in a first state, the latching assembly holds the securing member in the first position, and, in a second state, the latching assembly releases the securing member to allow the securing member to pivot from the first position to the second position;

wherein the latching assembly comprises a movable latching member configured to selectively move between a first position in which the latching member engages the securing member and a second position in which the latching member releases the securing member;

wherein the securing member comprises a body, a plunger disposed in the body and movable between an extended position and a retracted position, and a biasing member arranged to bias the plunger to the extended position;

wherein the latching member, when in the first position, engages the plunger to prevent the securing member from pivoting from the first position to the second position.

3. A door assembly, comprising:

a door frame including a first side section, a second side section, and a top section connecting the first and second side sections;

a door coupled to the second side section such that the door is pivotable between a closed position and an open position, the door having a height;

a securing member pivotably mounted to the door frame, wherein the securing member extends along a height of the first side section, and wherein the securing member is pivotable between a first position, in which the securing member engages the door along a majority of the height of the door to hold the door in the closed position and prevent the door from moving to the open position, and a second position, in which the securing member releases the door to allow the door to be pivoted from the closed position to the open position; and a latching assembly mounted to the first side section, wherein, in a first state, the latching assembly holds the securing member in the first position, and, in a second state, the latching assembly releases the securing member to allow the securing member to pivot from the first position to the second position;

wherein the latching assembly comprises a movable latching member configured to selectively move between a first position in which the latching member engages the securing member and a second position in which the latching member releases the securing member; wherein the latching assembly comprises:

a frame;

a lever block having a first end pivotally mounted to the frame;

a solenoid having a plunger that is operatively coupled to the lever block; and a turnable handle that is operatively coupled to the lever block, wherein the latching member is coupled to the lever block such that actuating the solenoid or turning the handle pivots the lever block to move the latching member to the second position.

4. A door assembly, comprising:

a door frame including a first side section, a second side section, and a top section connecting the first and second side sections;

a door coupled to the second side section such that the door is pivotable between a closed position and an open position, the door having a height;

a securing member pivotably mounted to the door frame, wherein the securing member extends along a height of the first side section, and wherein the securing member is pivotable between a first position, in which the securing member engages the door along a majority of the height of the door to hold the door in the closed position and prevent the door from moving to the open position, and a second position, in which the securing member releases the door to allow the door to be pivoted from the closed position to the open position; and a latching assembly mounted to the first side section, wherein, in a first state, the latching assembly holds the securing member in the first position, and, in a second state, the latching assembly releases the securing member to allow the securing member to pivot from the first position to the second position;

wherein the securing member is generally C-shaped having a first leg, a second leg, and an intermediate section connecting the first leg and second leg, and wherein the door includes an outer end portion having a convex surface and the securing member includes a concave channel arranged between the first and second legs and adapted to receive the convex surface.

5. The door assembly of claim 4 further comprising a compression seal disposed in the channel between the securing member and the door.

* * * * *